US006971358B2

(12) United States Patent
Shimatsu

(10) Patent No.: US 6,971,358 B2
(45) Date of Patent: Dec. 6, 2005

(54) INTAKE SYSTEM FOR INTERNAL COMBUSTION ENGINE AND METHOD OF CONTROLLING INTERNAL COMBUSTION ENGINE

(75) Inventor: Takayuki Shimatsu, Tochigi-ken (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/109,812

(22) Filed: Apr. 20, 2005

(65) Prior Publication Data

US 2005/0235940 A1 Oct. 27, 2005

(30) Foreign Application Priority Data

Apr. 22, 2004 (JP) ..... 2004-127198
Apr. 22, 2004 (JP) ..... 2004-127204
Sep. 29, 2004 (JP) ..... 2004-284288
Sep. 29, 2004 (JP) ..... 2004-284819

(51) Int. Cl.[7] ..... F02M 35/10
(52) U.S. Cl. ..... 123/184.21; 123/184.22; 123/184.23
(58) Field of Search ..... 123/399, 395, 123/294, 445, 480, 184.21, 184.22, 184.23, 123/184.25, 184.26, 184.35, 184.43, 184.48

(56) References Cited

U.S. PATENT DOCUMENTS 5,269,272 A * 12/1993 Nakaniwa ..... 123/339.22
5,532,930 A * 7/1996 Kako ..... 701/103
6,718,960 B2 * 4/2004 Someno et al. ..... 123/704
2003/0070494 A1 4/2003 Kanke et al.
2004/0118376 A1 6/2004 Dohta

FOREIGN PATENT DOCUMENTS

JP 3-233168 10/1991
JP 2887111 2/1999
JP 2001-82260 3/2001
JP 2002-364469 12/2002
JP 2003-120406 4/2003
JP 2004-190591 7/2004

* cited by examiner

*Primary Examiner*—Bibhu Mohanty
(74) *Attorney, Agent, or Firm*—Squire, Sanders & Dempsey LLP

(57) ABSTRACT

An intake system has a tubular intake manifold, having an end connected to an intake port of an engine and an opposite end connected to a throttle body that includes a throttle valve. The intake system also has a bypass passage, connected to the intake manifold downstream of the throttle valve, and an air flow meter disposed in the bypass passage for detecting an amount of intake air drawn into the engine. A portion of the intake air that flows through the intake manifold is divided and flows into the bypass passage, wherein the amount of intake air flowing through the bypass passage is detected by the air flow meter.

17 Claims, 17 Drawing Sheets

INTAKE SYSTEM FOR INTERNAL COMBUSTION ENGINE AND METHOD OF CONTROLLING INTERNAL COMBUSTION ENGINE

BACKGROUND OF THE INVENTION

1. Field of the Invention

The present invention relates to an intake system for use in an internal combustion engine, which measures an amount of intake air drawn into the internal combustion engine and controls operation of the internal combustion engine based on the measured amount of intake air, and a method of controlling operation of an internal combustion engine.

2. Description of the Related Art

Internal combustion engines that have heretofore been used on motor vehicles or the like have an intake manifold for introducing intake air into the cylinders which provide combustion chambers and intake valves mounted in respective intake ports, to which the intake manifold is connected, for selectively bringing the cylinders into and out of communication with the intake manifold. When the intake valves are opened, intake air is introduced through the intake manifold into the cylinders.

The intake manifold houses therein a throttle valve for regulating the rate of intake air (amount of intake air) flowing through the intake manifold. The valve opening of the throttle valve is varied to regulate the amount of intake air introduced into the cylinders. An air flow sensor, for measuring or detecting the amount of intake air flowing through the intake manifold, is disposed upstream of the throttle valve. A detected signal from the air flow sensor is output to a control circuit, which calculates the amount (mass or volume) of intake air introduced into the cylinders from the detected signal from the air flow sensor. Then, the control circuit calculates an optimum amount of fuel to be injected into the cylinders depending on the operating state of the internal combustion engine based on the calculated amount of intake air. The control circuit then outputs a control signal representing the calculated optimum amount of fuel to a fuel injector, which injects the calculated optimum amount of fuel into the cylinders.

In the above intake system, the air flow sensor for detecting the amount of intake air introduced into the cylinders is disposed upstream of the throttle valve, as described above. When the throttle valve is quickly opened in order to rapidly accelerate the motor vehicle, intake air for filling the intake manifold is introduced into the intake manifold, in addition to the intake air that is actually introduced into the cylinders. Therefore, the amount of intake air that is detected by the air flow sensor is the sum of intake air actually introduced into the cylinders and intake air filling the intake manifold.

A detector such as a pressure sensor or the like is disposed in the intake manifold, separately from the air flow sensor, for detecting the pressure of intake air in the intake manifold. The amount of intake air that fills the intake manifold is estimated, and subtracted from the total amount of intake air detected by the air flow sensor, thereby estimating the amount of intake air that is actually drawn into the cylinders for controlling the internal combustion engine.

With the above intake system, however, the amount of intake air drawn into the cylinders is estimated based on the amount of intake air detected by the air flow sensor disposed upstream of the throttle valve. Consequently, the control circuit fails to accurately recognize the amount of intake air actually introduced into the cylinders, and is unable to accurately control the amount of fuel injected into the cylinders based on the amount of intake air.

Because the air flow sensor is positioned upstream of the throttle valve in the intake manifold, a difference is developed between the time when the amount of intake air is detected by the air flow sensor and the time when the intake valves are opened to draw a mixture of intake air and fuel into the cylinders.

Furthermore, since the detector, such as a pressure sensor or the like, is required for estimating the amount of intake air that fills the intake manifold, the cost of the overall intake system including the measuring units is relatively high.

To solve the above problems, Japanese Patent No. 2887111 and Japanese Laid-Open Patent Publication No. 2003-120406 disclose an intake system having sensors disposed respectively upstream and downstream of the throttle valve in an intake manifold, for measuring an amount of intake air drawn into the engine cylinders.

Japanese Laid-Open Patent Publication No. 2004-190591 also discloses an intake system having a surge tank disposed downstream of the throttle valve in an intake manifold, and a pressure sensor disposed in the surge tank for detecting the pressure in the intake manifold. A detected signal from an air flow sensor is output to a control circuit, which calculates the amount (mass or volume) of intake air introduced into the cylinders from the detected signal from the air flow sensor. Then, the control circuit calculates an optimum amount of fuel to be injected into the cylinders depending on the operating state of the internal combustion engine based on the calculated amount of intake air. The control circuit then outputs a control signal representing the calculated optimum amount of fuel to a fuel injector, thereby controlling the fuel injector.

According to the above conventional intake systems, when the throttle valve is opened and closed, the flow of intake air downstream of the throttle valve tends to be disturbed, making it difficult for the sensor disposed downstream of the throttle valve to measure the amount of intake air accurately.

While the internal combustion engine is in operation, unburned gases produced in the combustion chambers thereof are liable to find their way through the intake ports and flow into the intake manifold downstream of the throttle valve when the intake valves are opened. Exhaust gases discharged from the combustion chambers are partially recirculated to the cylinders through the intake ports, for performing exhaust gas recirculation, in order to remove harmful components contained in the exhaust gases. Therefore, the detecting element of the sensor disposed downstream of the throttle valve may become contaminated by the unburned gases and the recirculated exhaust gases, tending to lower the detection accuracy of the sensor.

SUMMARY OF THE INVENTION

It is a general object of the present invention to provide an intake system for use in an internal combustion engine, which detects an amount of intake air drawn into the internal combustion engine with increased accuracy and controls operation of the internal combustion engine highly accurately, and a method of controlling operation of an internal combustion engine.

A major object of the present invention is to provide an intake system for use in an internal combustion engine, which detects an amount of intake air drawn into the internal combustion engine with increased accuracy and which prevents a detector for detecting an amount of intake air from becoming contaminated, and a method of controlling an intake system for use in an internal combustion engine.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
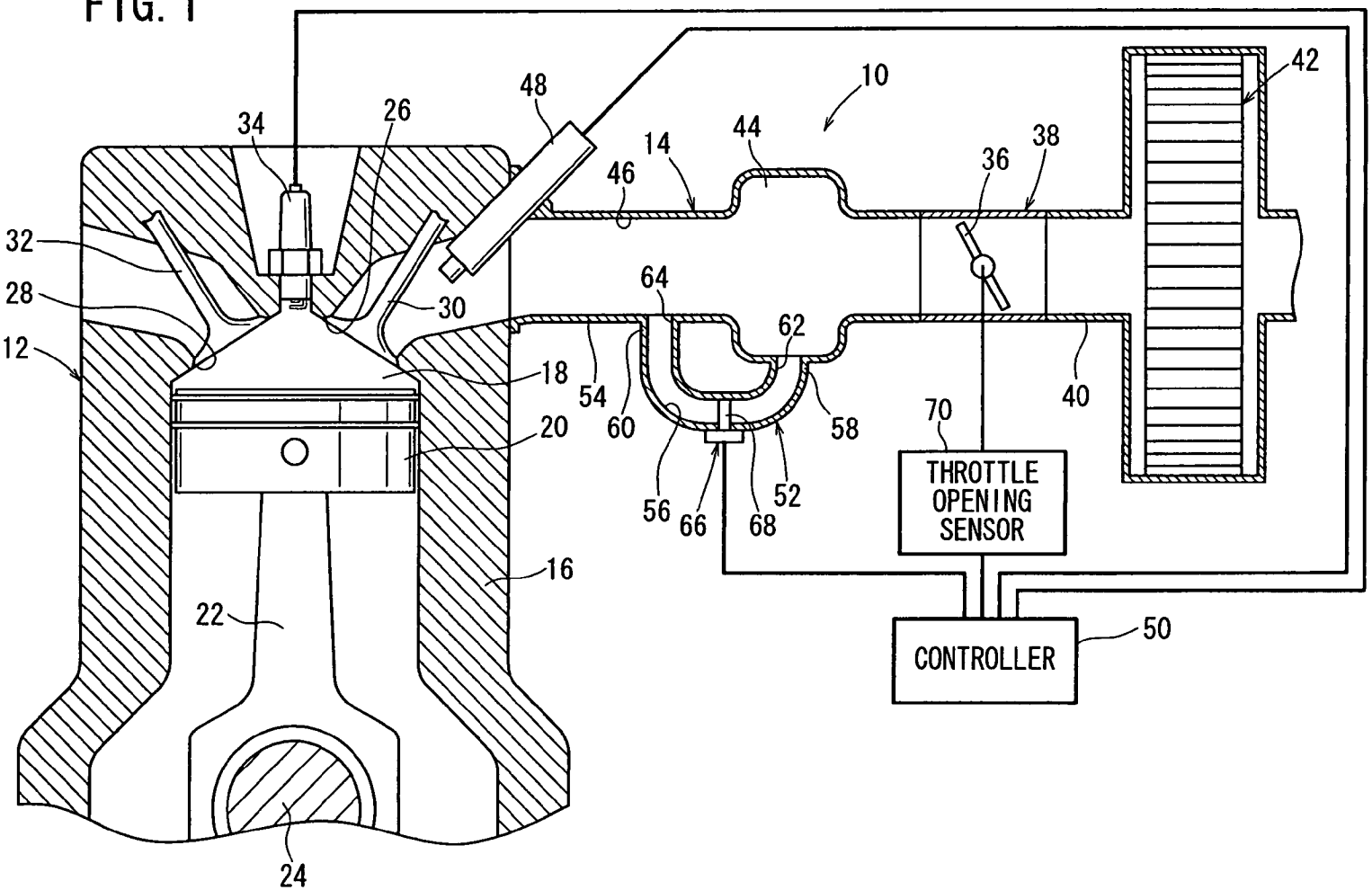
FIG. 1 is a schematic cross-sectional view, partly in block form, of an intake system for an internal combustion engine according to a first embodiment of the present invention.

FIG. 1 shows an intake system 10 for an internal combustion engine according to a first embodiment of the present invention. A method of controlling operation of an internal combustion engine according to the present invention is applied to the intake system 10.

The intake system 10 is combined with an engine (internal combustion engine) 12 for use on a motor vehicle or the like. In addition to having its own capability to introduce intake air into the engine 12, the intake system 10 serves to measure an amount of intake air drawn into the engine 12. The motor vehicle on which the intake system 10 is installed may be an automobile, a motorcycle, or the like.

As shown in FIG. 1, the engine 12 has a plurality of cylinder chambers 18 (one shown) defined in an engine body 16, and a plurality of pistons 20 (one shown) axially displaceably disposed in the cylinder chamber 18. When the piston 20 is displaced in its stroke, it changes the volume of the cylinder chamber 18 to cause the engine 12 to operate in intake, compression, power, and exhaust strokes. The displacement of the piston 20 is output as drive power from the engine 12, from the piston 20 through a connecting rod 22 and a crankshaft 24.

The engine body 16 has an intake port 26 and an exhaust port 28 defined therein, which open into each of the cylinder chambers 18. An intake valve 30 is operatively disposed in the intake port 26, and an exhaust valve 32 is operatively disposed in the exhaust port 28. A spark plug 34 is disposed in the engine body 16 in the upper end of the cylinder chamber 18 between the intake port 26 and the exhaust port 28.

Figure 2:
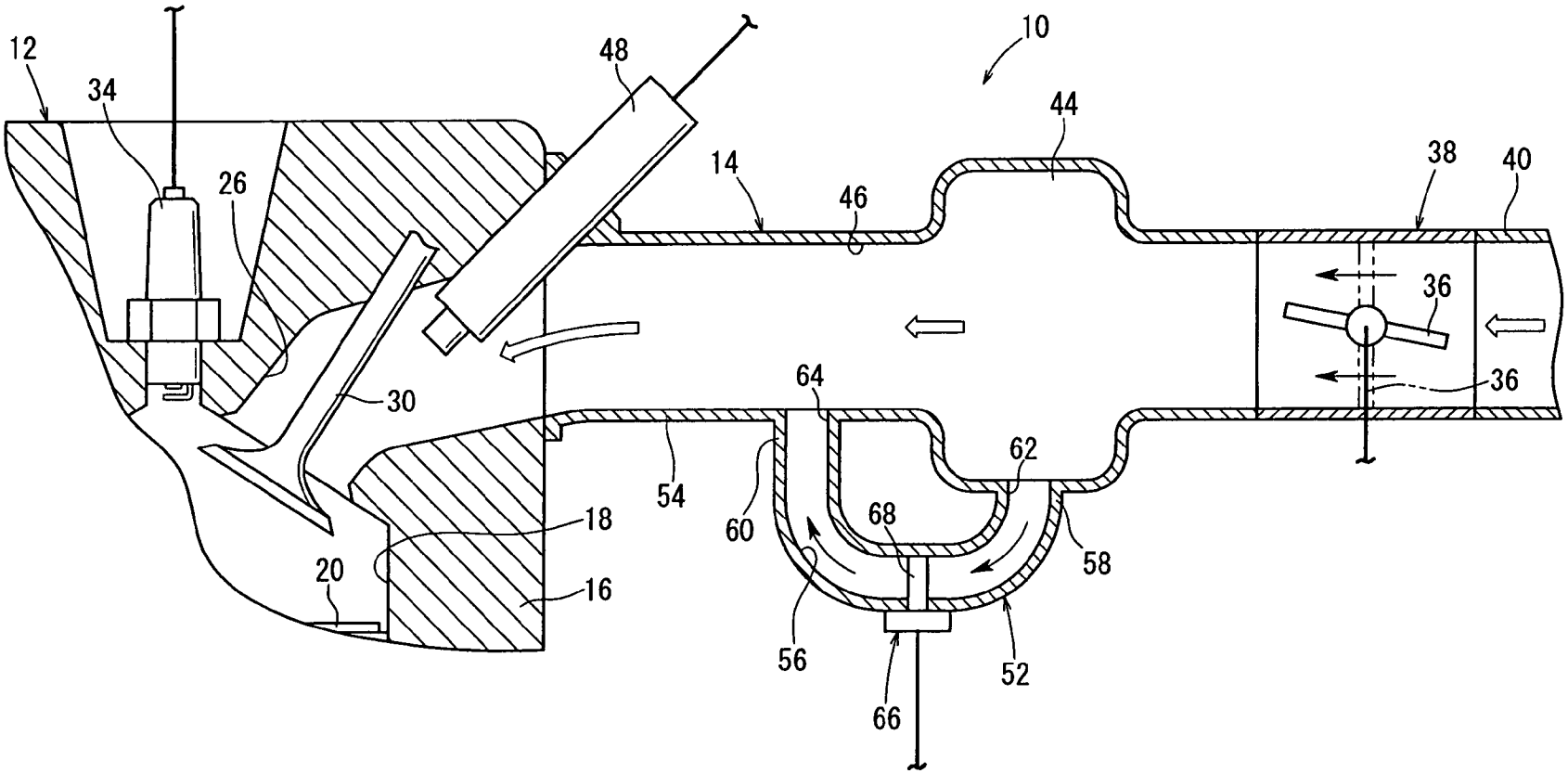
FIG. 2 is an enlarged fragmentary cross-sectional view of the intake system of the internal combustion engine shown in FIG. 1, showing parts in an intake stroke, in which an intake valve is lifted off the valve seat in an intake port.

As shown in FIG. 2, an intake manifold 14, which is of a tubular structure for introducing intake air from outside of the motor vehicle, is connected to the intake port 26. A throttle body 38, including a throttle valve 36 that can be opened and closed in co-operated relation to an accelerator pedal (not shown), is connected to an end of the intake manifold 14 remote from the engine body 16. An air cleaner 42 is connected to the throttle body 38 by an intake pipe 40. Intake air is introduced from outside of the motor vehicle through the air cleaner 42 into the intake manifold 14. At this time, the air cleaner 42 removes dust particles from the intake air as it passes through the air cleaner 42.

A tank 44 having a predetermined volume is disposed in the end of the intake manifold 14 that is connected to the throttle body 38.

The intake manifold 14 defines therein an intake passage (main intake passage) 46 through which intake air flows. An injector 48, functioning as a fuel injection valve, is disposed in the end of the intake manifold 14 which is connected to the intake port 26 in confronting relation to the intake port 26. The injector 48 injects fuel into the intake port 26 communicating with the intake passage 46 under the control of an electric signal supplied from a controller 50.

A tubular bypass pipe (auxiliary intake passage) 52 has a first connecting end 58 connected to the tank 44 of the intake manifold 14 and an opposite second connecting end 60 connected to a wall 54 of the intake manifold 14 downstream of the tank 44 in communication with the intake passage 46. The bypass pipe 52 defines therein a bypass passage 56 that is smaller in diameter than the intake passage 46. The first connecting end 58 of the bypass pipe 52 need not be connected to the tank 44, but may also be connected to the intake manifold 14 near the throttle body 38, and the second connecting end 60 of the bypass pipe 52 may be connected to the intake manifold 14 near the engine body 16.

That is, the first connecting end 58 may be connected to the intake manifold 14 anywhere downstream of the throttle body 38, and the second connecting end 60 may be connected to the intake manifold 14 at a position closer to the cylinder chamber 18.

The bypass passage 56 communicates with the intake passage 46 in the intake manifold 14 through a first opening 62 defined in the first connecting end 58 and a second opening 64 defined in the second connecting end 60.

Therefore, intake air that flows through the intake manifold 14 is introduced from the first connecting end 58 into the bypass passage 56 in the bypass pipe 52 and then is introduced again into the intake manifold 14 through the second connecting end 60.

Stated otherwise, intake air that flows through the intake passage 46 is branched from the first connecting end 58 into the bypass passage 56, and then flows from the bypass pipe 52 back into the intake passage 46 through the second connecting end 60.

An air flow meter (amount-of-air detector) 66, for detecting an amount of intake air flowing through the bypass passage 56, is disposed in the bypass pipe 52. The air flow meter 66, which functions as an amount-of-air detector, is located at a position where intake air flows in a stable laminar flow through the bypass passage 56.

The air flow meter 66 has a detecting element 68, which may comprise a silicon chip with a thin film of platinum evaporated thereon, for example. When intake air flows around the detecting element 68, the detecting element 68, which is controlled so as to maintain a constant temperature, changes in temperature, causing a change in the amount of current that is supplied to the detecting element 68 for keeping the temperature thereof constant. The air flow meter 66 may be of a hot-wire type, which detects the change in the amount of supplied current, thereby detecting the mass flow of intake air flowing through the bypass passage 56.

The air flow meter 66 is not necessarily a hot-wire type, but alternatively may be of any of other various types of air flow meters. For example, the air flow meter 66 may be a Karman vortex type, for detecting a volumetric amount of intake air flowing through the bypass passage 56 by detecting vortexes generated downstream of a resistive member that is disposed in the bypass passage 56 as a flow resistance member, or the air flow meter 66 may be a flap type, for detecting a volumetric amount of intake air flowing through the bypass passage 56 by detecting an angular displacement of a flap that is pushed by intake air flowing through the bypass passage 56.

The controller 50 comprises an ECU (Electronic Control Unit), for example, which is electrically connected to the spark plug 34, the injector 48, and the air flow meter 66. Based on an output signal from the air flow meter 66, the controller 50 outputs output signals respectively to the spark plug 34 and the injector 48, for controlling the ignition timing of the spark plug 34, the fuel injection timing of the injector 48, and the amount of fuel injected by the injector 48 (see FIG. 1).

The opening of the throttle valve 36 is detected by a throttle opening sensor 70 that is mounted on the throttle body 38, for example. The throttle valve 36 applies an output signal representing the opening of the throttle valve 36 to the controller 50.

The intake system 10 according to the first embodiment of the present invention, to which a method of controlling the intake system according to the present invention is applied, is basically constructed as described above. Control operations and advantages of the intake system 10 will be described below.

With the engine 12 started, the driver of the motor vehicle depresses the accelerator pedal (not shown) to open the throttle valve 36, as shown in FIG. 2. In the intake stroke, when the intake valve 30 is lifted off the valve seat in the intake port 26 and the piston 20 is displaced downwardly, intake air is introduced from the air cleaner 42 (see FIG. 1) into the intake manifold 14 under an intake negative pressure from the cylinder chamber 18.

Part of the intake air that is introduced through the throttle valve 36 into the intake passage 46 in the intake manifold 14 is introduced through the tank 44 from the first connecting end 58 into the bypass passage 56. At this time, the air flow meter 66 on the bypass pipe 52 detects the amount of intake air, which flows in a stable laminar flow through the bypass passage 56.

The intake air that has passed through the bypass passage 56 then flows through the second connecting end 60 back into the intake passage 46, and is thereafter drawn, together with the intake air flowing through the intake passage 46 from the tank 44, into the cylinder chamber 18.

The air flow meter 66 outputs a detected signal, which is representative of the amount of intake air, to the controller 50, which calculates an optimum amount of fuel to be injected into the cylinder chamber 18 based on the detected signal. The controller 50 then outputs a control signal to the injector 48, which is representative of the calculated optimum amount of fuel to be injected into the cylinder chamber 18. As a result, the injector 48 injects the optimum amount of fuel into the intake air flowing through the intake passage 46 in the vicinity of the intake port 26. An air-fuel mixture that is made up of the fuel and the intake air is drawn into the cylinder chamber 18.

A process for determining an amount of intake air to be drawn through the intake system 10 into the cylinder chamber 18 will be described in detail below with reference to FIGS. 3 and 4. It is assumed that the engine 12 is in a state where the amount of intake air drawn into the cylinder chamber 18 gradually increases by increasing the throttle opening in order to increase the output power of the engine 12 for accelerating the motor vehicle, and the amount of injected fuel gradually varies in proportion to the increase in the amount of intake air.

Figure 3:
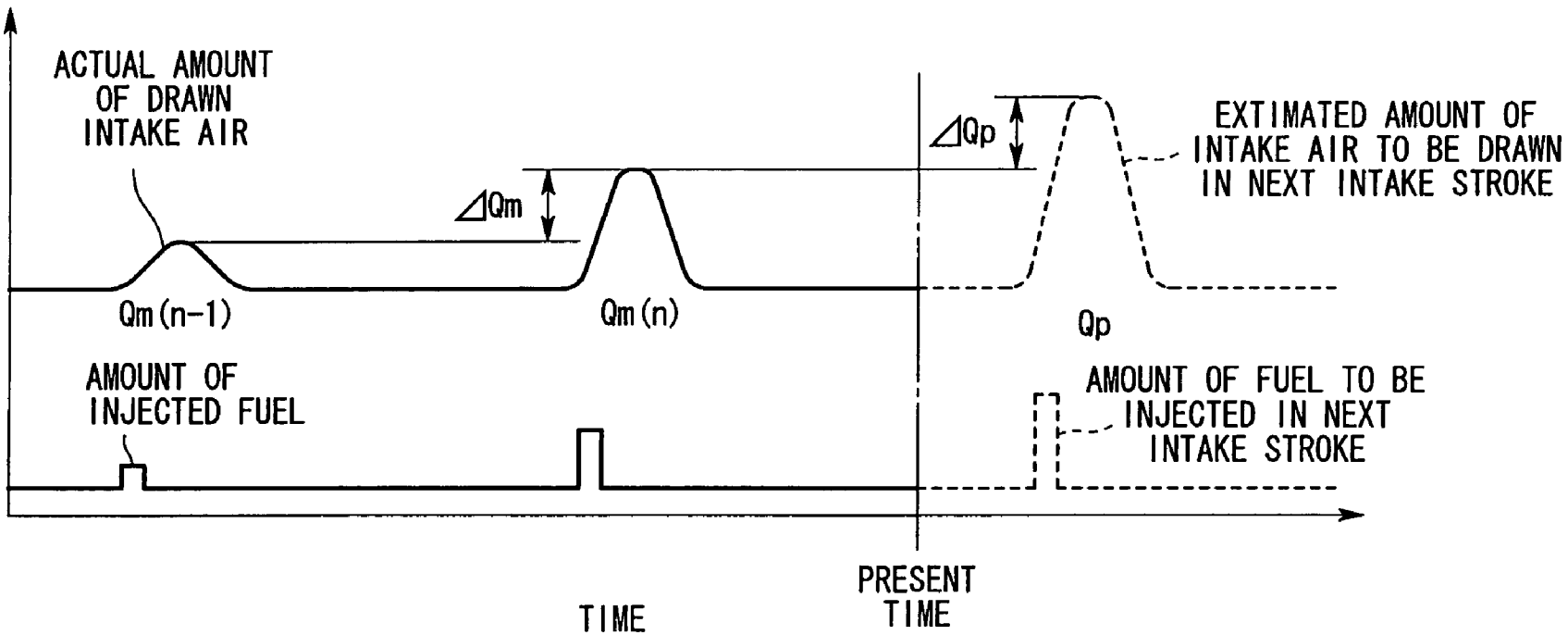
FIG. 3 is a diagram showing a characteristic curve representing the amount of drawn intake air detected by the intake system shown in FIG. 1, plotted against time.

The air flow meter 66 detects an actual amount Qm(n) of intake air that is actually drawn into the cylinder chamber 18 in the last intake stroke of the engine 12, and an actual amount Qm(n−1) of intake air that is actually drawn into the cylinder chamber 18 in the intake stroke before last of the engine 12, and the detected amounts Qm(n), Qm(n−1) of intake air are stored in a memory (not shown), as shown in FIG. 3.

Figure 4:
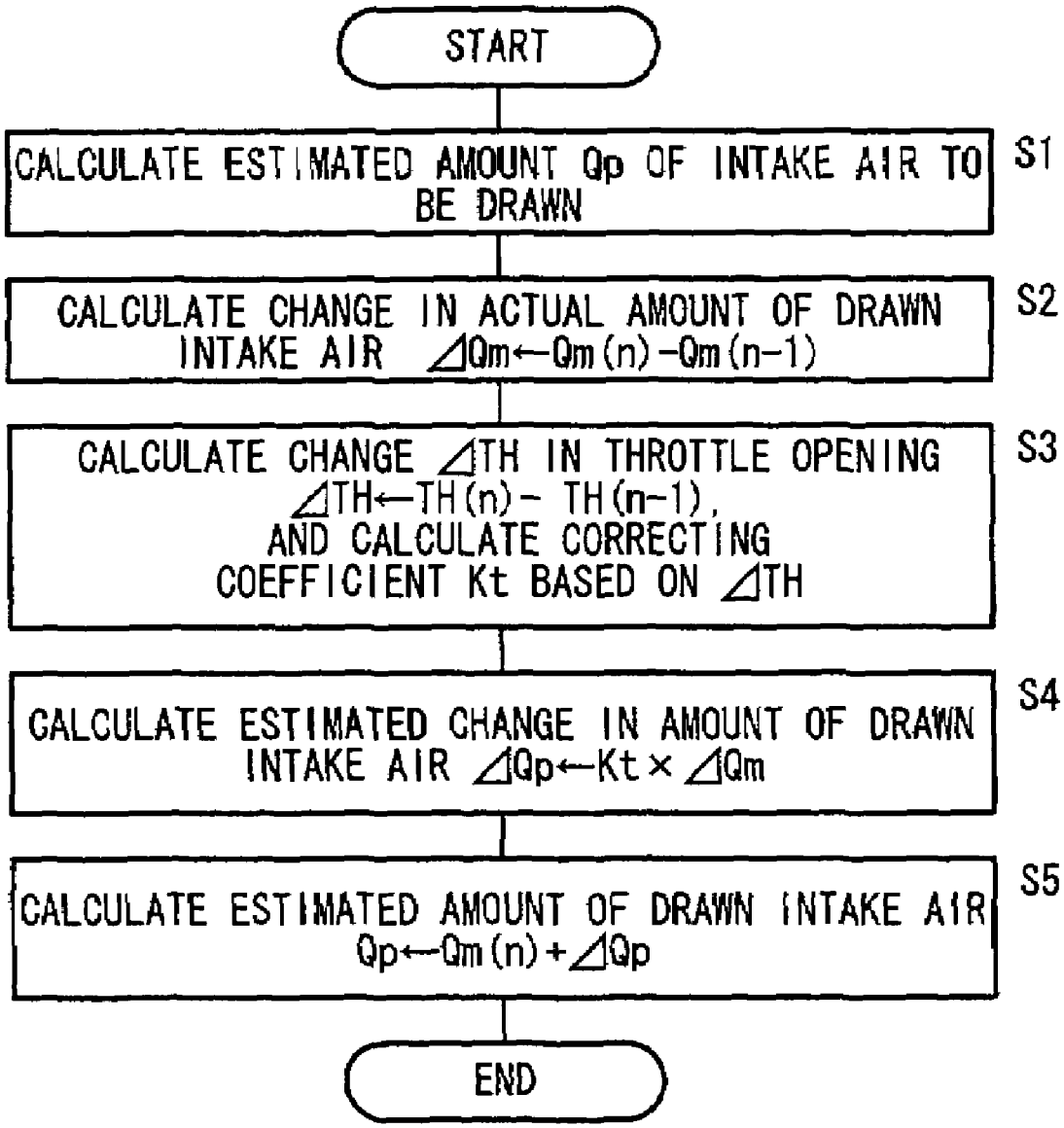
FIG. 4 is a flowchart of a process of estimating an amount of intake air to be drawn in a next intake stroke based on an amount of drawn intake air that is actually drawn into a cylinder chamber.

In step S1 shown in FIG. 4, the controller 50 calculates an estimated amount Qp of intake air that is required to be drawn into the cylinder chamber 18 in the next intake stroke of the engine 12.

In step S2, the actual amount Qm(n−1) of intake air that is actually drawn into the cylinder chamber 18 in the intake stroke before last of the engine 12 is subtracted from the actual amount Qm(n) of intake air that is actually drawn into the cylinder chamber 18 in the last intake stroke of the engine 12, thereby calculating a change ΔQm in the actual amount of intake air between the last intake stroke and the intake stroke before last. If the throttle opening TH gradually increases for accelerating the motor vehicle, then the change ΔQm in the actual amount of intake air is of a positive value (ΔQm>0). Conversely, if the throttle opening TH gradually decreases for decelerating the motor vehicle, then the change ΔQm in the actual amount of intake air is of a negative value (ΔQm<0).

In step S3, a throttle opening TH(n−1) detected by the throttle opening sensor 70 in the intake stroke before last is subtracted from a throttle opening TH(n) detected by the throttle opening sensor 70 in the last intake stroke, thereby calculating a change ΔTH in the throttle opening. A correcting coefficient Kt for correcting the change ΔQm(n) in the actual amount of intake air with respect to the change ΔTH in the throttle opening is calculated from a table preset in the controller 50.

Specifically, if the change ΔTH in the throttle opening increases, then it is assumed that the change ΔQm(n) in the actual amount of intake air also increases. Conversely, if the change ΔTH in the throttle opening decreases, then it is assumed that the change ΔQm(n) in the actual amount of intake air also decreases.

In step S4, the change ΔQm(n) in the actual amount of intake air is multiplied by the correcting coefficient Kt, calculating a estimated change ΔQp in the actual amount of intake air, which represents an increase or a decrease in the amount of air to be drawn in the next intake stroke as compared with the last intake stroke. Since the estimated change ΔQp in the actual amount of intake air is corrected based on not only the change ΔQm(n) in the actual amount of intake air, but also the change ΔTH in the throttle opening, the estimated change ΔQp in the actual amount of intake air can be estimated highly accurately, for more closely approximating the actual change in the actual amount of intake air.

Finally, in step S5, the estimated change ΔQp in the actual amount of intake air is added to the change ΔQm(n) in the actual amount of intake air in the last intake stroke, thereby calculating an estimated amount Qp of intake air to be drawn into the cylinder chamber 18 in the next intake stroke. Based on the estimated amount Qp of intake air to be drawn into the cylinder chamber 18, the controller 50 outputs a control signal to the injector 48, which injects a corresponding amount of fuel into the cylinder chamber 18. In this manner, the engine 12 is controlled based on the estimated amount Qp of intake air according to the estimating process shown in FIG. 4.

The volume of the cylinder chamber 18, into which the intake air is drawn, is calculated in advance, and stored in the controller 50. When the controller 50 calculates the estimated amount Qp of intake air, the controller 50 calculates the estimated amount Qp of intake air so as not to exceed the volume of the cylinder chamber 18. The estimated amount Qp of intake air is thus prevented from being erroneously estimated. Stated otherwise, when the controller 50 calculates the estimated amount Qp of intake air, the controller 50 uses the volume of the cylinder chamber 18 as a maximum value for the estimated amount Qp of intake air. In this manner, the controller 50 can calculate the estimated amount Qp of intake air highly accurately.

According to the first embodiment of the present invention, as described above, the amount of intake air drawn into the cylinder chamber 18 is detected by the air flow meter 66 disposed in the bypass passage 56, and the actual amount Qm of intake air that is actually drawn into the cylinder chamber 18 is calculated by the controller 50 based on the amount of intake air detected by the air flow meter 66. The change ΔQm in the actual amount of intake air is calculated from the actual amounts Qm(n), Qm(n−1) of intake air that are actually drawn into the cylinder chamber 18 in the last intake stroke and in the intake stroke before last of the engine 12. The calculated change ΔQm in the actual amount of intake air is then added to the actual amount Qm(n) of intake air in the last intake stroke, thereby calculating the estimated amount Qp of intake air to be actually drawn into the cylinder chamber 18 in the next intake stroke.

Therefore, the estimated amount Qp of intake air in the next intake stroke can be calculated highly accurately based on the actual amounts Qm(n), Qm(n−1) of intake air that are actually drawn in the last intake stroke and the intake stroke before last.

Furthermore, the change ΔQm in the actual amount of intake air, which is calculated based on the actual amounts Qm(n), Qm(n−1) of intake air, is corrected by the correcting coefficient Kt based on the change ΔTH in the throttle opening TH. Accordingly, the estimated amount Qp of intake air is calculated based on not only the actual amounts Qm(n), Qm(n−1) of intake air, but also the change ΔTH in the throttle opening TH. The estimated amount Qp of intake air in the next intake stroke can thus be calculated highly accurately.

Consequently, prior to the next intake stroke of the engine 12, the estimated amount Qp of intake air, to be drawn into the cylinder chamber 18 in the next intake stroke, can be calculated highly accurately from the change ΔQm in the actual amount of intake air, based on the actual amounts Qm(n), Qm(n−1) of intake air that are measured in the last intake stroke and the intake stroke before last by the air flow meter 66 and the throttle opening TH. The amount of fuel to be injected can thus be controlled highly accurately based on the estimated amount Qp of intake air, thus optimizing an air-fuel ratio, which is the ratio of the amount of intake air to be drawn into the cylinder chamber 18 to the amount of fuel to be injected into the intake air. As a result, the engine 12 can be controlled highly accurately in real time from the amount of injected fuel and the amount of drawn intake air.

Unburned gases produced in the cylinder chamber 18 tend to find their way through the intake port 26 and into the intake manifold 14 downstream of the throttle valve 36, and exhaust gases discharged from the cylinder chamber 18 partially flow back into the cylinder chamber 18 for exhaust gas recirculation. However, since the bypass passage 56 in the bypass pipe 52 is smaller in diameter than the intake passage 46 in the intake manifold 14, flows of unburned gases and exhaust gases into the bypass passage 56 are reduced.

As a result, the detecting element 68 of the air flow meter 66, which is disposed in the bypass pipe 52, is prevented from becoming contaminated by unburned gases and exhaust gases, and hence the detection accuracy of the air flow meter 66 for detecting the amount of intake air is prevented from being lowered.

Heretofore, it has been difficult to install an air flow sensor in an area where turbulent flows of intake air occur, which are caused when the throttle valve is opened and closed. According to the present invention, since the air flow meter 66 is mounted on the bypass pipe 52, the air flow meter 66 is not exposed to turbulent flows of intake air caused when the throttle valve is opened and closed, and the air flow meter is capable of detecting, reliably and highly accurately, the amount of intake air that flows through the bypass pipe 52.

Therefore, the air flow meter 66 can be installed in the intake system 10 with greater layout leeway than would be possible using a conventional air flow sensor mounted directly on the pipe of the intake manifold.

Because the intake system 10 does not require a detector, such as a pressure sensor or the like, which has heretofore been needed for detecting the amount of intake air for filling the intake manifold, the cost of the intake system 10 is relatively low.

The intake manifold 14 and the intake pipe 40 have a predetermined length along the pipe through which intake air flows. Therefore, pulsations in the intake air tend to occur in the intake passage 46 when intake air flows through the intake passage 46. However, any effect that such pulsations may have on the air flow meter 66 is reduced, since the air flow meter 66 is positioned closely to the cylinder chamber 18.

Figure 5:
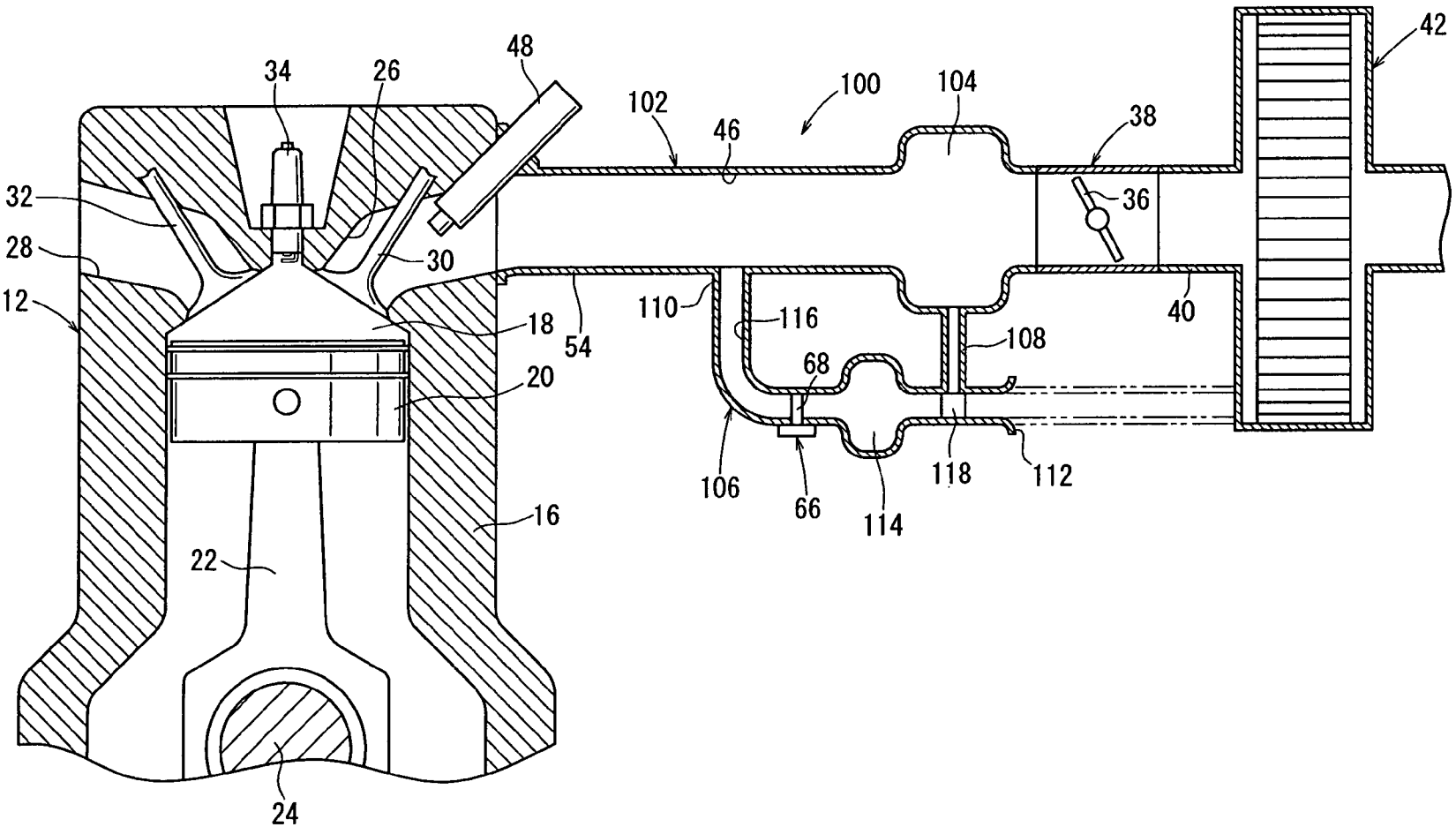
FIG. 5 is a schematic cross-sectional view, partly in block form, of an intake system for an internal combustion engine according to a first modification.

FIG. 5 shows an intake system 100 for an internal combustion engine according to a first modification. Those parts of the intake system 100 which are identical to those of the intake system 10 according to the first embodiment are denoted by identical reference characters, and such features shall not be described in detail below.

The intake system 100 according to the first modification differs from the intake system 10 according to the first embodiment in that a first tank 104, having a predetermined volume, is disposed in the end of an intake manifold 102 that is connected to the throttle body 38, and a pipe (auxiliary intake passage) 106 is connected to the wall 54 of the intake manifold 102 downstream of the throttle body 38 in communication with the intake passage 46, wherein the pipe 106 is connected to the first tank 104 by a passageway 108.

The pipe 106 has a connecting end 110 connected to the wall 54 of the intake manifold 102 and an opposite open end 112 that is open outwardly. The pipe 106 includes a second tank 114, having a predetermined volume and a diameter greater than the diameter of the pipe 106, disposed between the connecting end 110 and the open end 112. The open end 112 of the pipe 106 may be connected to the air cleaner 42 separately from the intake pipe 40 connected to the intake manifold 102, as indicated by the two-dot-and-dash lines in FIG. 5. Stated otherwise, the open end 112 may be connected to a position upstream of the throttle valve 36.

When intake air is introduced from the air cleaner 42 through the intake pipe 40 into the intake manifold 102, intake air is simultaneously introduced through the open end 112 into the pipe 106.

The pipe 106 has a passage 116 defined therein for passing intake air therethrough. The passage 116 is smaller in diameter than the intake passage 46 in the intake manifold 102.

The passageway 108 is connected to the first tank 104 and also to the pipe 106 between the open end 112 and the second tank 114. A pressure regulating mechanism 118, e.g., a pressure regulating valve, is disposed in the pipe 106 in facing relation to the passageway 108. The pressure regulating mechanism 118 operates to eliminate any pressure difference between intake air in the intake manifold 102 and intake air in the pipe 106. That is, the pressure regulating mechanism 118 operates to hold the pressure of intake air flowing through the intake passage 46 and the pressure of intake air flowing through the passage 116 substantially equal to each other.

The air flow meter 66 for detecting the amount of intake air flowing through the pipe 106 is disposed in the pipe 106 downstream of the second tank 114.

With the above arrangement, intake air flowing through the pipe 106 is directly introduced from the open end 112 of the pipe 106. Accordingly, intake air flows through the pipe 106 separately from the intake air flowing through the intake manifold 102. As a consequence, even when unburned gases produced in the cylinder chamber 18 enter the intake manifold 102 downstream of the throttle valve 36, and exhaust gases flow through the intake manifold 102 for exhaust gas recirculation, such unburned gases and exhaust gases are prevented from flowing into the pipe 106.

Therefore, the detecting element 68 of the air flow meter 66 that is disposed in the pipe 106 is prevented from becoming contaminated by unburned gases and exhaust gases, and hence the detection accuracy of the air flow meter 66 for detecting the amount of intake air is more effectively prevented from being lowered.

Figure 6:
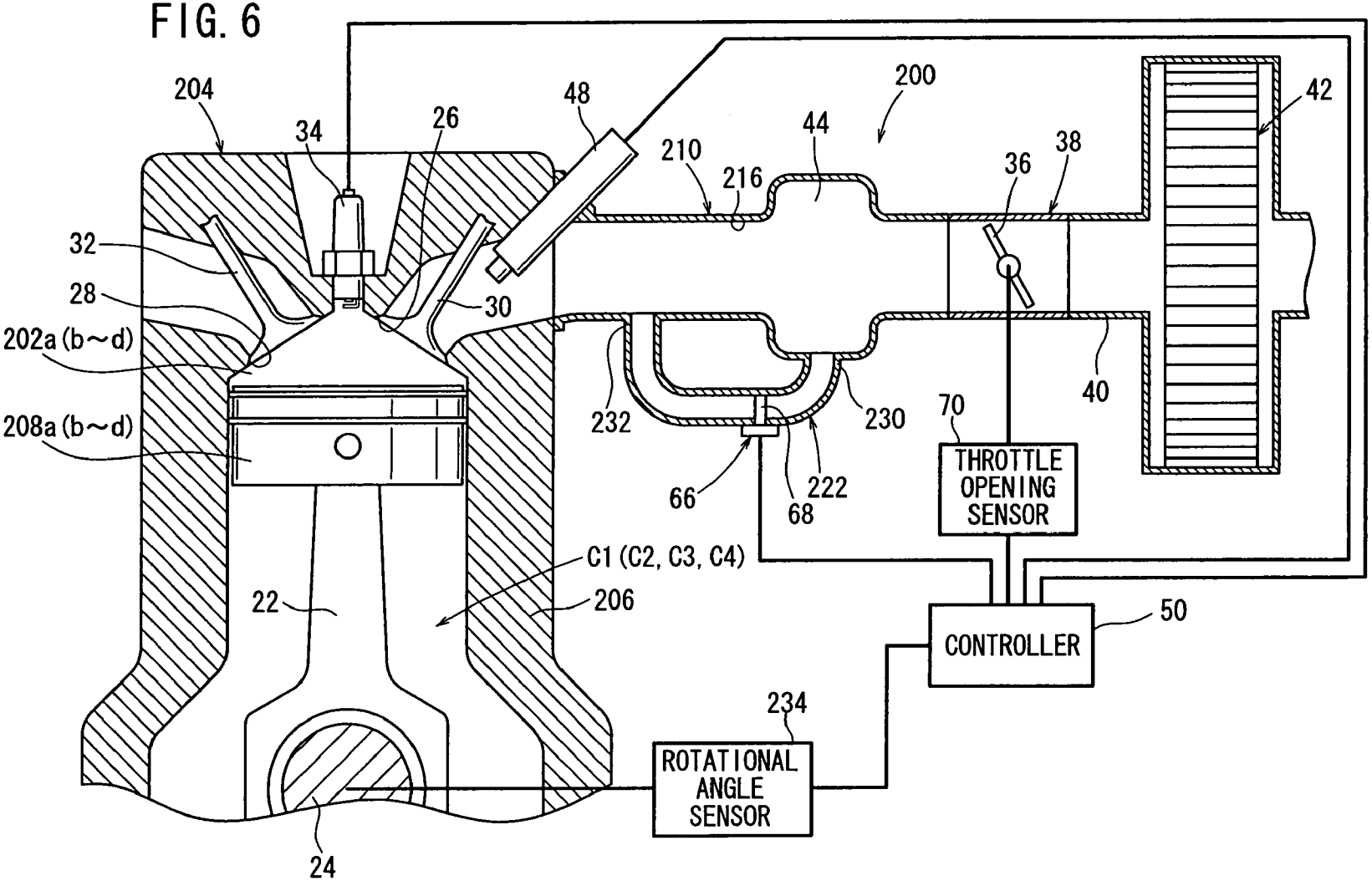
FIG. 6 is a schematic cross-sectional view, partly in block form, of an intake system for an internal combustion engine according to a second embodiment of the present invention.
Figure 7:
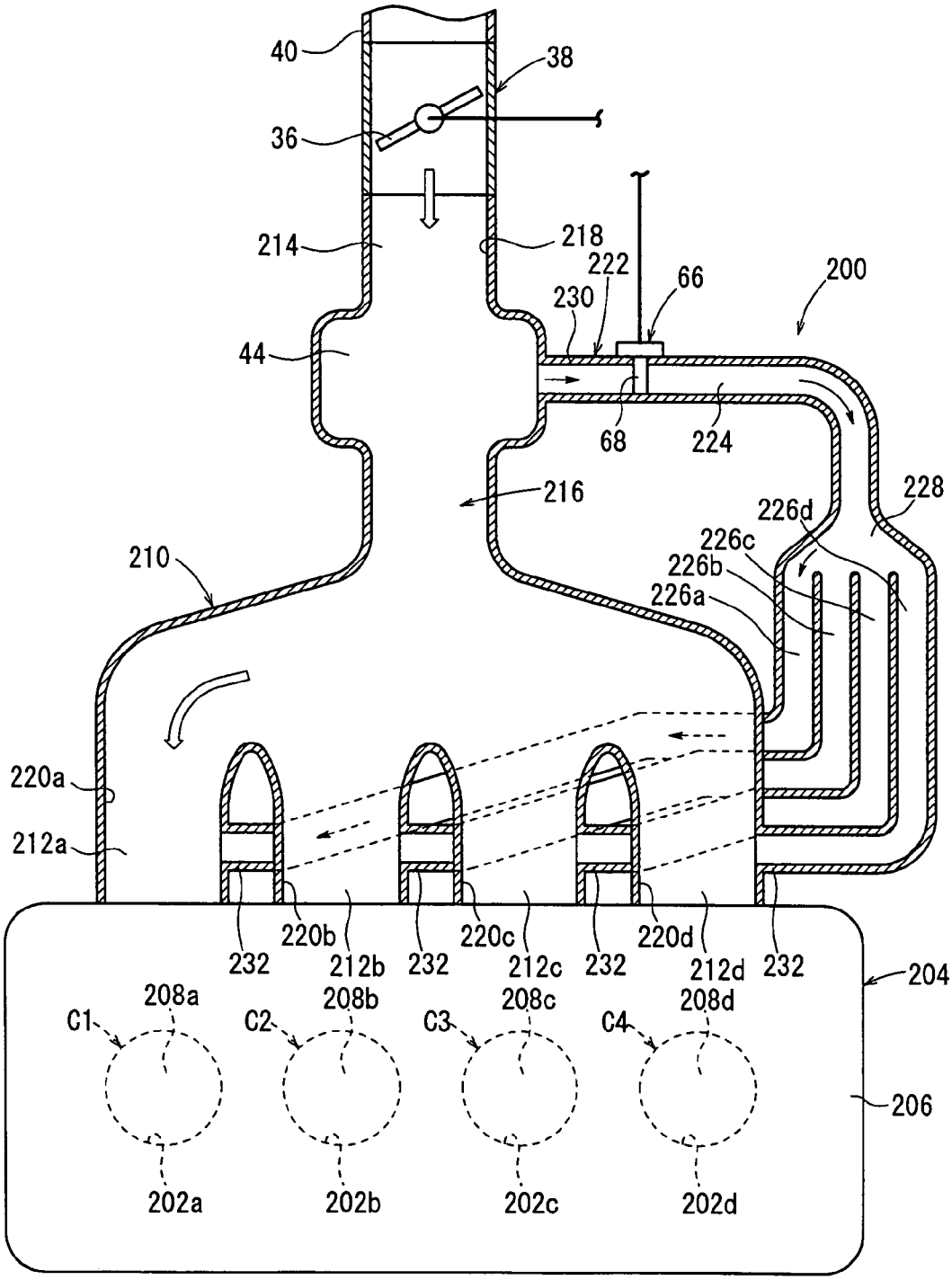
FIG. 7 is a horizontal cross-sectional view of the intake system shown in FIG. 6.

FIGS. 6 and 7 show an intake system 200 for an internal combustion engine according to a second embodiment of the present invention. The method of controlling operation of the internal combustion engine according to the present invention is applied to the intake system 200. Those parts of the intake system 200 which are identical to those of the intake system 10 according to the first embodiment are denoted by identical reference characters, and such features shall not be described in detail below.

The intake system 200 is combined with an engine (internal combustion engine) 204 having, for example, four cylinders, i.e., first through fourth cylinder chambers 202*a* through 202*d* (see FIG. 7), for use on a motor vehicle.

As shown in FIGS. 6 and 7, the engine 204 has first through fourth pistons 208*a* through 208*d* (see FIG. 2) axially displaceably disposed respectively in the first through fourth cylinder chambers 202*a* through 202*d* defined in an engine body (main body) 206. When the first through fourth pistons 208*a* through 208*d* are displaced in their stroke, they change the volumes of the respective first through fourth cylinder chambers 202*a* through 202*d* to cause the engine 204 to operate in intake, compression, power, and exhaust strokes.

Displacement of the first through fourth pistons 208*a* through 208*d* is output as drive power of the engine 204, from the first through fourth pistons 208*a* through 208*d*, and through connecting rods 22 and the crankshaft 24. The first through fourth pistons 208*a* through 208*d* and the first through fourth cylinder chambers 202*a* through 202*d* respectively define a first cylinder C1, a second cylinder C2, a third cylinder C3, and a fourth cylinder C4 (see FIG. 2).

Spark plugs 34 are disposed in the engine body 206, in upper ends of the respective first through fourth cylinder chambers 202*a* through 202*d*.

An intake manifold 210 has first through fourth branch pipes 212*a* through 212*d* (see FIG. 7), which are branched downstream and connected to respective intake ports 26 of the first through fourth cylinder chambers 202*a* through 202*d* in the engine body 206. The intake manifold 210 branches into the same number of first through fourth branch pipes 212*a* through 212*d* (four branch pipes) as the number of the first through fourth cylinder chambers 202*a* through 202*d*.

The intake manifold 210 also has a common pipe 214 extending upstream of the first through fourth branch pipes 212*a* through 212*d*. Stated otherwise, the intake manifold 210 branches from a single upstream common pipe 214 downwardly into the first through fourth branch pipes 212*a* through 212*d*. The common pipe 214 includes a tank 44 having a predetermined volume.

A throttle body 38, including a throttle valve 36 that can be opened and closed in co-operated relation to an accelerator pedal (not shown), is connected to the end of the intake manifold 210 upstream of the common pipe 214.

In the intake stroke of the engine 204, when the throttle valve 36 is opened, intake air is introduced through the throttle body 38 and the intake manifold 210, and flows from the intake ports 26 into the first through fourth cylinder chambers 202*a* through 202*d*, under an intake negative pressure developed as the first through fourth pistons 208*a* through 208*d* are successively displaced downwardly.

The intake manifold 210 has an intake passage (main intake passage) 216 defined therein, through which intake air flows. The intake passage 216 comprises a common passage 218 defined in the common pipe 214 and a plurality of branch passages 220*a* through 220*d* defined respectively in the first through fourth branch pipes 212*a* through 212*d*. Injectors 48 (see FIG. 6), which function as fuel injection valves, are disposed in the portions of the first through fourth branch pipes 212*a* through 212*d* that are joined to the intake ports 26, in confronting relation to the intake ports 26. The injectors 48 inject fuel into the intake ports 26 connected to the branch passages 220*a* through 220*d*, under the control of an electric signal supplied from a controller 50.

A bypass pipe (auxiliary intake passage) 222, for bypassing the manifold section between the tank 44 of the common pipe 214 and the first through fourth branch pipes 212*a* through 212*d*, is connected to the intake manifold 210. The bypass pipe 222 has an upstream inlet 224 connected to the tank 44, a plurality of downstream branches 226*a* through 226*d* associated with and connected to the respective first through fourth branch pipes 212*a* through 212*d*, and a common joint 228 joining the branches 226*a* through 226*d* to the inlet 224.

The inlet 224 has a first connecting end 230, which serves as an end of the bypass pipe 222, and which is connected to the tank 44 of the common pipe 214 of the intake manifold 210, thereby providing fluid communication between the bypass pipe 222 and the common passage 218 in the common pipe 214.

The branches 226*a* through 226*d* have second connecting ends 232, forming an opposite end of the bypass pipe 222, which are connected respectively to walls of the first through fourth branch pipes 212*a* through 212*d* of the intake manifold 210, thereby providing fluid communication between the bypass pipe 222 and the branch passages 220*a* through 220*d* defined respectively in the first through fourth branch pipes 212*a* through 212*d*. The inlet 224, the branches 226*a* through 226*d*, and the common joint 228 of the bypass pipe 222 are thinner (i.e., smaller in diameter) than the common pipe 214 and the first through fourth branch pipes 212*a* through 212*d* of the intake manifold 210.

The upstream first connecting end 230 of the bypass pipe 222 is not necessarily connected to the tank 44, but may be directly connected to the intake manifold 210 disposed near the throttle body 38. The downstream second connecting ends 232 of the bypass pipe 222 may be connected to the engine body 206 downstream of the intake manifold 210.

An air flow meter (amount-of-air detector) 66, for detecting an amount of intake air flowing through the bypass pipe 222, is disposed in the inlet 224 of the bypass pipe 222. The air flow meter 66 may also be disposed in the common joint 228 of the bypass pipe 222, rather than the inlet 224 thereof.

The intake system 200 according to the second embodiment of the present invention, to which the method of controlling the intake system according to the present invention is applied, is basically constructed as described above. Control operations and advantages of the intake system 200 will be described below.

With the engine 204 started, the driver of the motor vehicle depresses the accelerator pedal (not shown) to open the throttle valve 36, lifting the intake valves 30 off the valve seats in the intake ports 26. Therefore, in the intake stroke, when the first through fourth pistons 208*a* through 208*d* are successively displaced downwardly, intake air is introduced from the air cleaner 42 (see FIG. 6) into the intake manifold 210, under an intake negative pressure developed in the first through fourth cylinder chambers 202*a* through 202*d*.

A portion of the intake air that is introduced through the throttle valve 36 into the intake passage 216 is introduced through the tank 44 from the first connecting end 230 into the inlet 224. At this time, the air flow meter 66 on the bypass pipe 222 detects the amount of intake air, which flows in a stable laminar flow through the bypass pipe 222.

For example, when the first cylinder C1 defined by the first piston 208*a* and the first cylinder chamber 202*a* is in the intake stroke, intake air flows into the branch 226*a* through the common joint 228, and then flows into the branch passage 220*a* in the first branch pipe 212*a* connected to the first cylinder chamber 202*a* while the first piston 208*a* is displaced during its stroke, as shown in FIG. 7. Intake air from the bypass pipe 222 is combined with the intake air flowing through the intake passage 216 in the intake manifold 210, after which the combined intake air flows into the first cylinder chamber 202*a*.

The angular displacement of the crankshaft 24, or alternatively a camshaft of the engine 204, is detected by a rotational angle sensor 234 (see FIG. 6), which outputs a detected signal representing the present angular displacement of the crankshaft 24 or the like to the controller 50. Based on the detected signal from the rotational angle sensor 234, the controller 50 identifies which one of the first through fourth cylinders C1 through C4 is presently in an intake stroke.

Stated otherwise, the controller 50 confirms which of the first through fourth cylinder chambers 202*a* through 202*d* is supplied with the intake air detected by the air flow meter 66, based on the detected signals from the rotational angle sensor 234 and the air flow meter 66. Accordingly, the amount of intake air drawn into each of the first through fourth cylinder chambers 202*a* through 202*d* can be detected using a single air flow meter 66.

Figure 8:
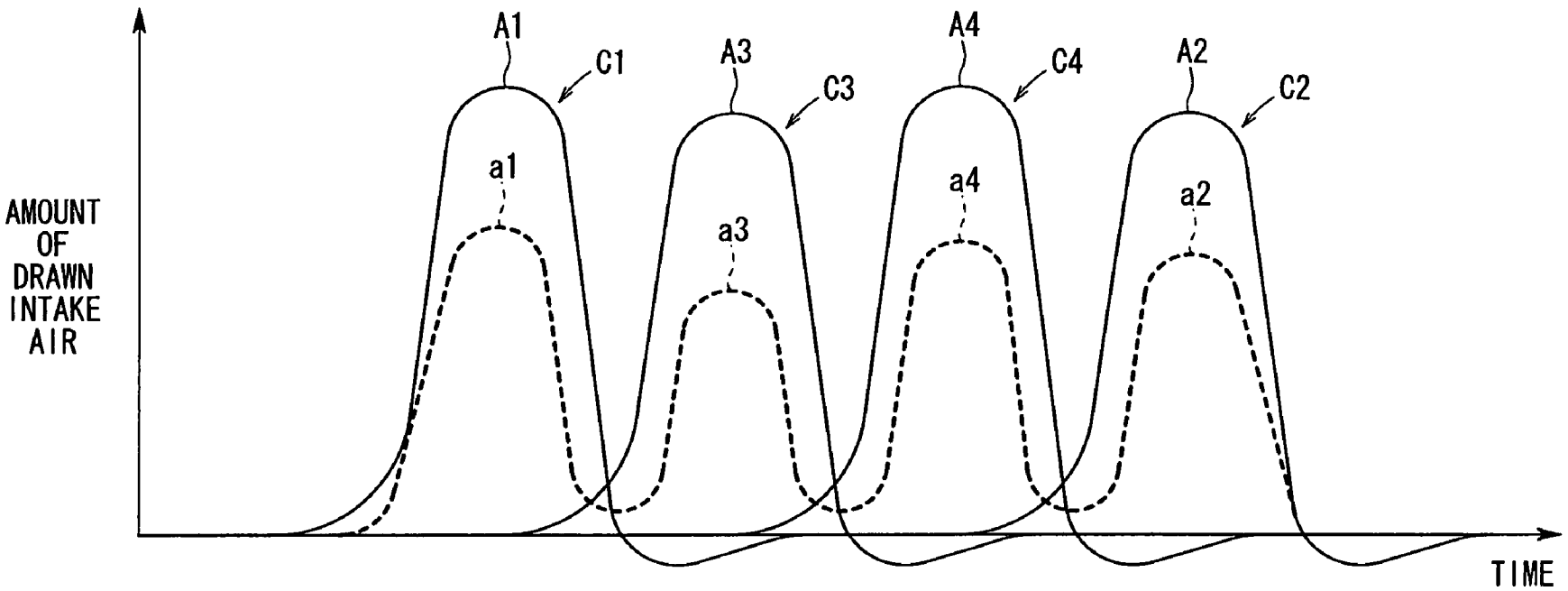
FIG. 8 is a diagram showing amounts of intake air, plotted against time, that are detected by the intake system shown in FIG. 6, as the intake air is drawn respectively into first through fourth cylinders.

As shown in FIG. 8, the air flow meter 66 outputs a detected value a1 of drawn intake air to the controller 50, and based on the detected value a1, the controller 50 calculates an amount A1 of intake air that actually flows into the first branch pipe 212*a*, while also calculating an optimum amount of fuel to be injected based on the amount A1 of intake air. The controller 50 outputs a control signal based on the calculated optimum amount of fuel to be injected to the injector 48 disposed in the first branch pipe 212*a*.

Based on the control signal, the injector 48 injects the fuel into the intake air flowing through the branch passage 220*a* in the first branch pipe 212*a* in the vicinity of the intake port 26, whereupon an air-fuel mixture, which is made up of the fuel and the intake air, is drawn into the cylinder chamber 18. FIG. 8 shows amounts A1 through A4 of intake air that are drawn respectively into the first through fourth cylinders C1 through C4, and detected values a1 through a4 of drawn intake air that are detected by the air flow meter 66, plotted against time, per unit time.

When the third piston 208*c* in the third cylinder C3, for example, is displaced, intake air is drawn through the third branch pipe 212*c* into the third cylinder chamber 202*c*, and the rotational angle sensor 234 confirms that the intake air is drawn into the third cylinder chamber 202*c*. Based on a detected value a3 that is detected by the air flow meter 66, the controller 50 calculates an amount A3 of intake air that is drawn into the third cylinder chamber 202*c*. The injector 48 disposed in the third branch pipe 212*c* injects an amount of fuel into the intake air as it is drawn into the third cylinder chamber 202*c*, based on the calculated amount A3 of intake air.

In this manner, intake air introduced through the throttle valve 36 into the intake manifold 210 flows into the first through fourth branch pipes 212*a* through 212*d* of the intake manifold 210, which are connected respectively to the first through fourth cylinders C1 through C4, during the intake stroke and under an intake negative pressure developed as the first through fourth pistons 208*a* through 208*d* are successively displaced downwardly in the first through fourth cylinder chambers 202*a* through 202*d*. At the same time, a portion of the intake air flows into the bypass pipe 222 connected to the intake manifold 210, and the amount of intake air flowing through the bypass pipe 222 is measured by the air flow meter 66. Operation of the intake system 200, at the time the second cylinder C2 and the fourth cylinder C4 are in the intake stroke, is identical to the operation at the time the third cylinder C3 is in the intake stroke, and shall not be described in detail below.

The controller 50 determines which one of the first through fourth cylinder chambers 202*a* through 202*d* the intake air detected by the air flow meter 66 is drawn into, based on the detected signal from the rotational angle sensor 234, and controls the injector 48 in the corresponding one of the first through fourth branch pipes 212*a* through 212*d* depending on the detected amount of intake air.

The output signal of the rotational angle sensor 234, which detects the angular displacement of the crankshaft 24 or the camshaft or the like of the engine 204, is then combined with the output signal from the air flow meter 66, to accurately measure the amounts of intake air that are drawn into the first through fourth cylinder chambers 202*a* through 202*d*, using a single air flow meter 66. Consequently, the engine 204 can be controlled highly accurately, and the intake system 200 can be manufactured at a lower cost than if the first through fourth cylinder chambers 202*a* through 202*d* were associated with respective air flow meters 66.

A process for estimating an amount of intake air to be drawn into the fourth cylinder chamber 202*d* of the engine 204, during the next intake stroke of the intake system 200, when the amounts of intake air drawn into the respective first through fourth cylinder chambers 202*a* through 202*d* are gradually increased depending on the throttle opening for accelerating the motor vehicle, shall be described in detail with reference to FIGS. 9 and 10.

Figure 9:
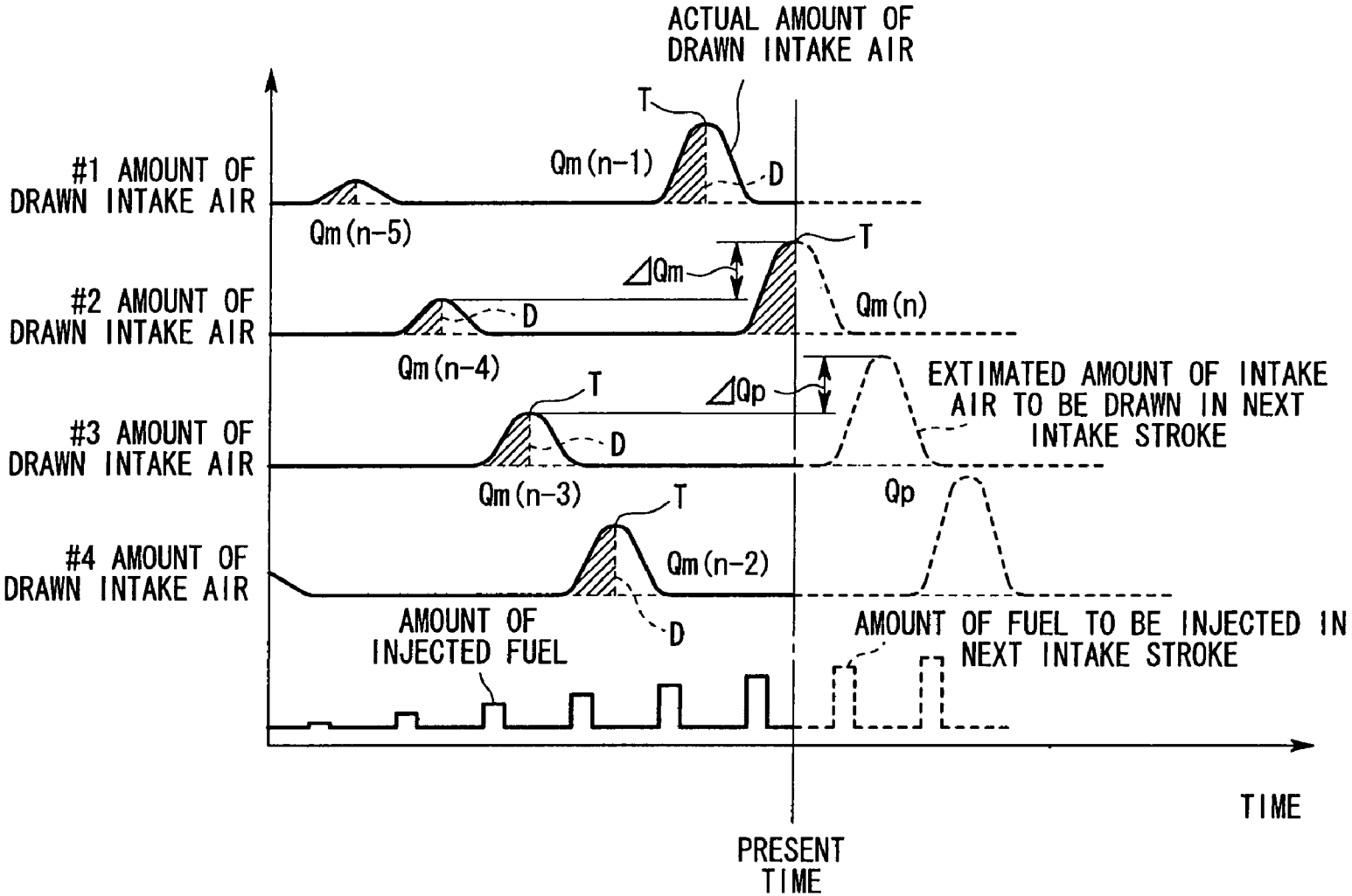
FIG. 9 is a diagram showing characteristic curves representing respective amounts of intake air, plotted against time, that are detected by the intake system shown in FIG. 6, as the intake air is drawn respectively into the first through fourth cylinders.

FIG. 9 shows characteristic curves representing changes in the actual amount Qm of intake air, plotted against time, that is actually drawn respectively into the first through fourth cylinder chambers 202*a* through 202*d* of the first through fourth cylinders C1 through C4, and also shows the manner in which the amount of injected fuel changes depending on changes in the actual amount Qm of intake air.

As shown in FIG. 9, when the first through fourth cylinders C1 through C4 of the engine 204 operate successively in their intake strokes, actual amounts Qm(n), Qm(n−1), Qm(n−2), Qm(n−3), Qm(n−4), Qm(n−5) of intake air, which are actually drawn into the first through fourth cylinder chambers 202*a* through 202*d* during the intake strokes, are detected by the air flow meter 66 and stored in a memory (not shown) of the controller 50.

Generally, four-cylinder engines having four cylinder chambers operate in intake, compression, power, and exhaust strokes successively, in order, from the first cylinder C1, the third cylinder C3, the fourth cylinder C4 and the second cylinder C3. The last intake stroke immediately prior to the intake stroke of the fourth cylinder C4 is the intake stroke of the third cylinder C3, and the intake stroke before last prior to the intake stroke of the fourth cylinder C4 is the intake stroke of the first cylinder C1.

Qm(n) represents the actual amount of intake air drawn into the third cylinder C3, Qm(n−1) the actual amount of intake air drawn into the first cylinder C1, Qm(n−2) the actual amount of intake air drawn into the second cylinder C2, Qm(n−3) the actual amount of intake air drawn into the fourth cylinder C4, Qm(n−4) the actual amount of intake air drawn into the third cylinder C3, and Qm(n−5) the actual amount of intake air drawn into the first cylinder C1. Stated otherwise, Qm(n−4) represents the actual amount of intake air drawn into the third cylinder C3 in the intake stroke before last with respect to the actual amount Qm(n) of intake air, and Qm(n−5) represents the actual amount of intake air drawn into the first cylinder C1 in the intake stroke before last with respect to the actual amount Qm(n−1) of intake air.

Figure 10:
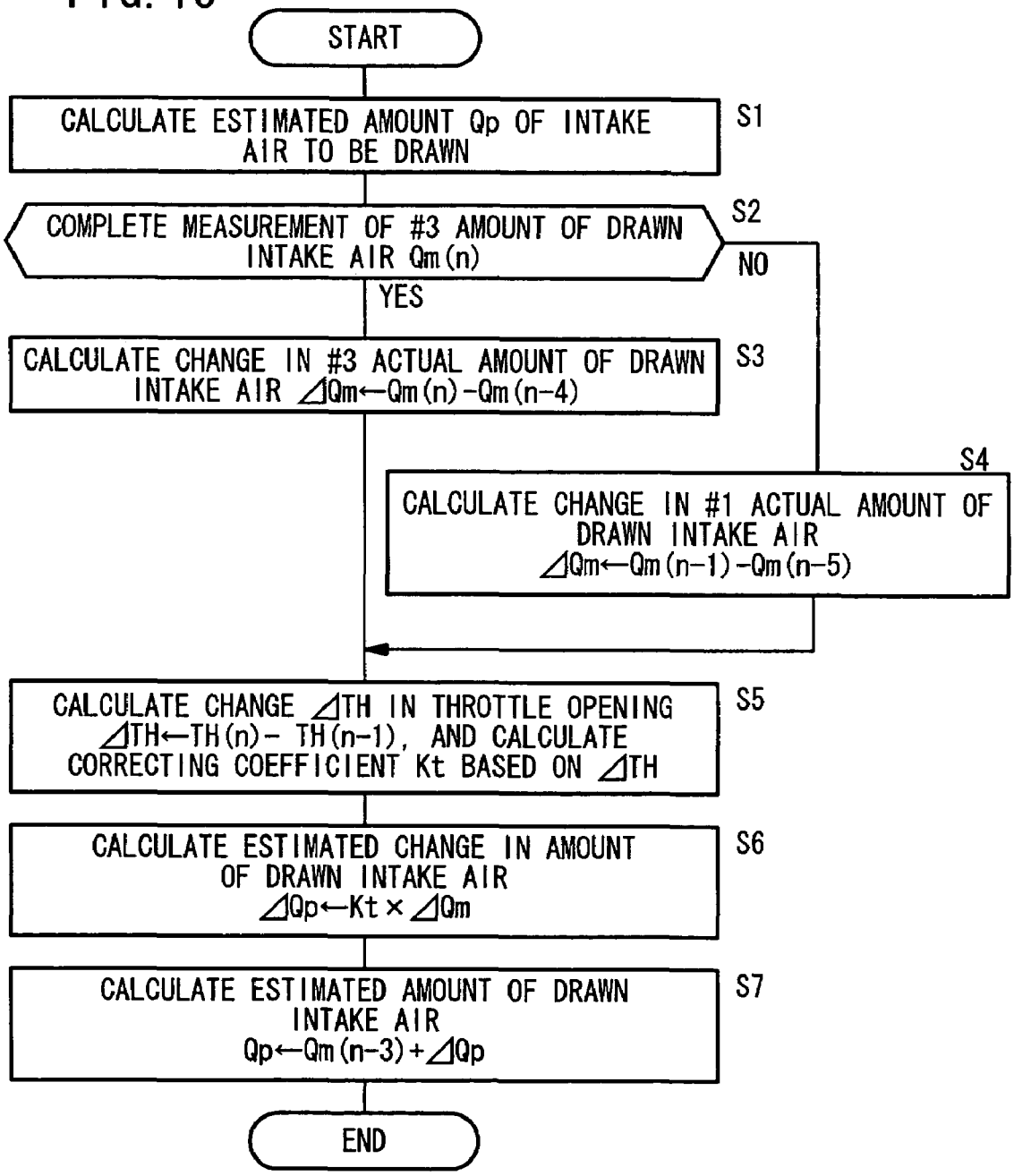
FIG. 10 is a flowchart of a process for estimating an amount of intake air to be drawn into the fourth cylinder in a next intake stroke based on amounts of intake air that are actually drawn into the first through fourth cylinders.

In step S1, as shown in FIG. 10, the controller 50 calculates an estimated amount Qp of intake air that is required to be drawn into the fourth cylinder chamber 202*d* of the fourth cylinder C4 during the next intake stroke of the engine 204.

In step S2, the controller 50 determines whether the measurement of the actual amount of drawn intake air has been completed in the last intake stroke closest to the present time. If measurement of the actual amount of intake air drawn into the third cylinder chamber 202*c* of the third cylinder C3 in the last intake stroke immediately prior to the intake stroke of the fourth cylinder C4 has been completed, then control goes to step S3. If measurement of the actual amount of intake air drawn into the third cylinder chamber 202*c* has not been completed, then control goes to step S4.

In step S3, the actual amount Qm(n−4) of intake air that is actually drawn into the third cylinder chamber 202*c* in the intake stroke before last is subtracted from the actual amount Qm(n) of intake air that is actually drawn into the third cylinder chamber 202*c* in the last intake stroke, as detected by the air flow meter 66. After a change ΔQm in the actual amount of intake air is calculated, from the difference between the actual amount Qm(n) of intake air drawn in the last intake stroke and the actual amount Qm(n−4) of intake air drawn in the intake stroke before last, control goes to step S5.

In step S4, since measurement of an actual amount of intake air drawn into the third cylinder chamber 202*c* in the last intake stroke immediately prior to the intake stroke of the fourth cylinder C4 has not been completed, the actual amount Qm(n−5) of intake air that is actually drawn into the first cylinder C1 in the intake stroke before last is subtracted from the actual amount Qm(n−1) of intake air that is actually drawn into the first cylinder C1 in the intake stroke that is closest and prior to the intake stroke of the third cylinder C3. After a change ΔQm in the actual amount of intake air is calculated from the difference between the actual amount Qm(n−1) of intake air drawn in the last intake stroke and the actual amount Qm(n−5) of intake air drawn in the intake stroke before last, control goes to step S5.

If the throttle opening TH gradually increases for accelerating the motor vehicle, then the change ΔQm in the actual amount of intake air is of a positive value (ΔQm>0). Conversely, if the throttle opening TH gradually decreases for decelerating the motor vehicle, then the change ΔQm in the actual amount of intake air is of a negative value (ΔQm<0).

In step S5, a throttle opening TH(n−1) detected by the throttle opening sensor 70 in the intake stroke before last is subtracted from the throttle opening TH(n) detected by the throttle opening sensor 70 in the last intake stroke, thereby calculating a change ΔTH in the throttle opening. A correcting coefficient Kt for correcting the change ΔQm(n) in the actual amount of intake air that is drawn into either of the third cylinder C3 or the first cylinder C1, with respect to the change ΔTH in the throttle opening, is calculated from a table preset in the controller 50.

In step S6, the change ΔQm(n) in the actual amount of intake air is multiplied by the correcting coefficient Kt, thereby calculating an estimated change ΔQp in the actual amount of intake air, which represents an increase or a decrease in the amount of air to be drawn into the fourth cylinder C4 in the next intake stroke as compared with the last intake stroke. Since the estimated change ΔQp in the actual amount of intake air is corrected based on not only the change ΔQm(n) in the actual amount of intake air, but also the change ΔTH in the throttle opening, the estimated change ΔQp in the actual amount of intake air can be estimated highly accurately in closer approximation to the actual change in the actual amount of intake air.

Finally, in step S7, the estimated change ΔQp in the actual amount of intake air is added to the change ΔQm(n−3) in the actual amount of intake air drawn into the fourth cylinder C4 in the last intake stroke, thereby calculating an estimated amount Qp of intake air to be drawn into the fourth cylinder chamber 202*d* in the next intake stroke. Based on the estimated amount Qp of intake air to be drawn into the fourth cylinder chamber 202*d*, the controller 50 outputs a control signal to the injector 48, which injects a corresponding amount of fuel into the fourth cylinder chamber 202*d*. In this manner, the engine 204 is controlled based on the estimated amount Qp of intake air according to the estimating process shown in FIG. 8.

In the foregoing process, an amount of intake air to be drawn into the fourth cylinder C4 of the engine 204 in the next intake stroke is estimated. Actual amounts of intake air to be drawn into the first through third cylinders C1 through C3 of the engine 204, in subsequent intake strokes, are estimated in the same manner. Accordingly, the process for estimating actual amounts of intake air to be drawn into the first through third cylinders C1 through C3 shall not be described below.

As shown in FIG. 9, the actual amount Qm of drawn intake air that is detected by the air flow meter 66 is represented as a mountain-shaped curve, having a crest T in each intake stroke of the first through fourth cylinders C1 through C4. Stated otherwise, the actual amount Qm of drawn intake air is represented as a curve having a substantially symmetrical shape with respect to a hypothetical vertical line passing through the crest T.

When the air flow meter 66 stops measuring the actual amount of drawn intake air at the crest T, where the actual amount Qm of drawn intake air is maximum, about one half (shown hatched) of the actual amount Qm of drawn intake air has been measured. Therefore, the controller 50 is able to calculate the actual amount Qm of drawn intake air by doubling the value of one half of the actual amount of drawn intake air.

Since the period of time required to measure the actual amount of drawn intake air is reduced to about one half, and only a slight period of time is required for the controller 50 to calculate the actual amount Qm of drawn intake air based on the measured actual amount of drawn intake air, the period of time required for obtaining the actual amount Qm of drawn intake air is considerably shorter than if the entire actual amount Qm of drawn intake air were measured by the air flow meter 66.

Therefore, for calculating the estimated amount Qp of drawn intake air in the next intake stroke, the actual amount Qm of drawn intake air in the last intake stroke can quickly be fed back to the controller 50. As a result, even if the intake strokes of the first through fourth cylinders C1 through C4 are close in time to each other due to high-speed rotation of the engine 204, the actual amount Qm of drawn intake air in the closest last intake stroke can appropriately be fed back, for calculating the estimated amount Qp of drawn intake air in the next intake stroke.

Furthermore, by shortening the period of time required for obtaining the actual amount Qm of drawn intake air, the number of times that the air flow meter 66 measures the amount of drawn intake air can be increased, thereby controlling the intake system more accurately.

According to the second embodiment of the present invention, as described above, amounts of intake air drawn into the respective first through fourth cylinder chambers 202*a* through 202*d* of the engine 204 are detected by the air flow meter 66 disposed in the bypass pipe 222. The controller 50 calculates actual amounts Qm of intake air drawn into the first through fourth cylinder chambers 202*a* through 202*d*, based on the amounts of intake air that are detected by the air flow meter 66.

The controller 50 calculates a change ΔQm in the actual amount of drawn intake air based on the actual amount of intake air that is actually drawn into the cylinder chamber of any one (e.g., the third cylinder C3) of the first through fourth cylinders C1 through C4 that has operated in the last intake stroke, and then adds the calculated change ΔQm in the actual amount of drawn intake air to the actual amount of drawn intake air detected in the last intake stroke with respect to the cylinder (e.g., the third cylinder C3) for which an amount of drawn intake air is to be estimated, thereby calculating an estimated amount Qp of intake air to be actually drawn in the next intake stroke. In this manner, it is possible to estimate, with high accuracy, an estimated amount Qp of drawn intake air in the next intake stroke, based on actual amounts Qm of intake air that are drawn in the last stroke and the stroke before last.

When an amount of intake air to be drawn into the fourth cylinder C4 in the next intake stroke is estimated, while the engine 204 is operating in a high rotational speed range, for example, the actual amount Qm(n) of intake air drawn into the third cylinder C3 in the last intake stroke, which is closest in time to the next intake stroke of the fourth cylinder C4, possibly may not be measurable in time, i.e., it may be impossible to complete the measurement thereof. In such a case, it is possible to estimate the amount of intake air to be drawn in the next intake stroke, based on the actual amount Qm(n−1) of intake air drawn into another cylinder, i.e., the first cylinder C1, which is in the intake stroke before last closest in time to the last intake stroke of the third cylinder C3.

The controller 50 then multiplies the calculated change ΔQm in the actual amount of drawn intake air, which has thus been calculated based on the actual amount Qm of drawn intake air, by the correcting coefficient Kt based on the change ΔTH in the throttle opening TH. It is thus possible to produce an estimated amount Qp of drawn intake air, which takes into account not only the actual amount Qm of intake air in the intake system 200, but also the change in the throttle opening TH. Consequently, an estimated amount Qp of drawn intake air in the next intake stroke can be calculated with higher accuracy.

Accordingly, the amount of fuel to be injected can be controlled highly accurately, based on the estimated amount Qp of drawn intake air. An air-fuel ratio, which is the ratio of the amount of intake air to be drawn into each of the first through fourth cylinder chambers 202*a* through 202*d* and the amount of fuel to be injected into the drawn intake air, can be optimized. As a result, the engine 204 can be controlled highly accurately in real time, based on the amount of injected fuel and the amount of drawn intake air.

In the second embodiment, as shown in FIGS. 6 and 7, a single air flow meter 66 is disposed in the inlet 224 of the bypass pipe 222. However, as shown in FIG. 11, plural air flow meters 66*a* through 66*d* may be disposed respectively in the branches 226*a* through 226*d* of the bypass pipe 222 of the intake system 200*a*.

Figure 11:
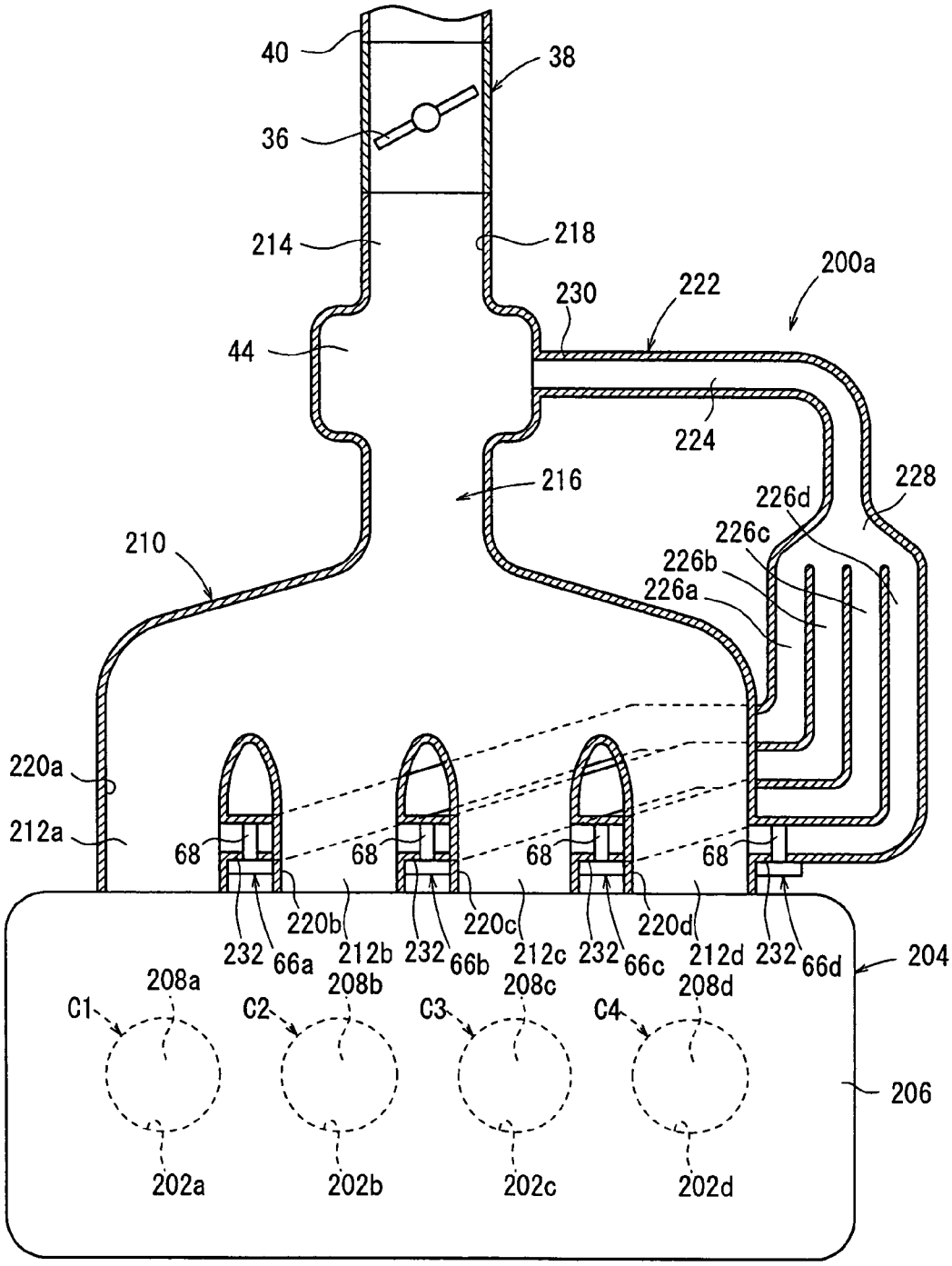
FIG. 11 is a horizontal cross-sectional view of a modification of the intake system shown in FIG. 6, with air flow meters disposed respectively in branches of a bypass pipe.

The intake system 200*a* shown in FIG. 11 allows the amounts of intake air drawn into the respective first through fourth cylinder chambers 202*a* through 202*d* in the engine body 206 to be measured independently of each other. Therefore, the intake strokes of the first through fourth cylinder chambers 202*a* through 202*d* can be recognized without the need for the rotational angle sensor 234 for detecting the angular displacement of the crankshaft 24, a camshaft, or the like of the engine 204.

Since the amounts of intake air drawn into the respective first through fourth cylinder chambers 202*a* through 202*d* can be detected highly accurately, even if the amounts of intake air are different from each other, the engine 204 can be controlled more accurately. In addition, the number of parts making up the intake system 200*a*, and the cost thereof, can be reduced, because the rotational angle sensor 234 for identifying cylinders in the intake stroke of the engine 204 is not required.

The air flow meters 66 is not necessarily disposed respectively in the branches 226*a* through 226*d* of the bypass pipe 222. However, two air flow meters 66 may be disposed respectively in two of the branches 226*a* through 226*d* of the bypass pipe 222, and a single air flow meter 66 may be disposed in the inlet 224 of the bypass pipe 222. That is, the number of air flow meters 66 may be smaller than the number of the first through fourth branch pipes 212*a* through 212*d* of the intake manifold 210, which correspond to the number of cylinders C1 through C4 of the engine 204.

Figure 12:
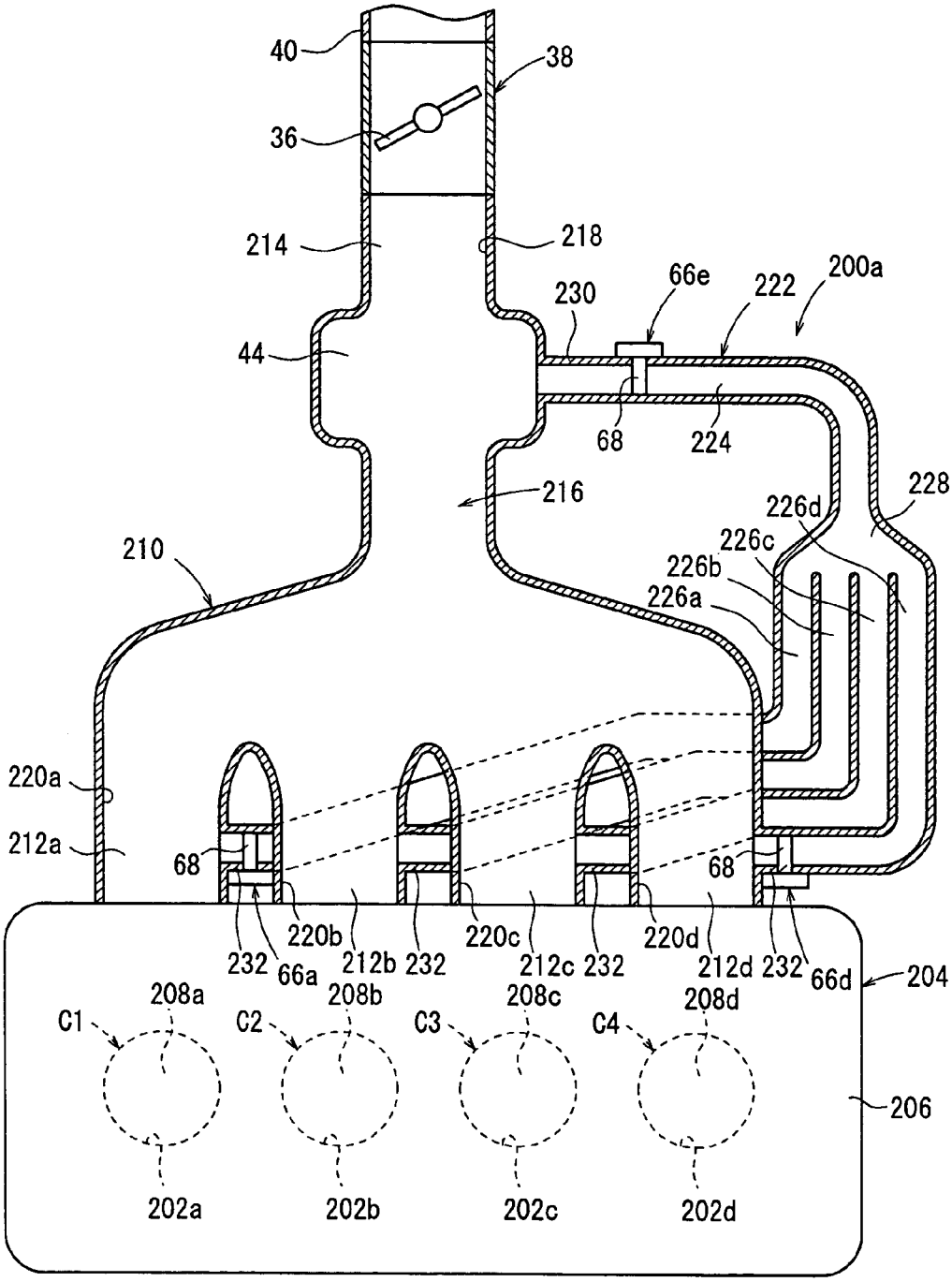
FIG. 12 is a horizontal cross-sectional view of another modification of the intake system shown in FIG. 6, with air flow meters disposed in some of the branches of a bypass pipe, and a single air flow meter disposed in an inlet of the bypass pipe.

For example, FIG. 12 shows another modification, in which air flow meters 66*a*, 66*d* are disposed in only the branches 226*a*, 226*d* of the bypass pipe 222. No air flow meters are disposed in the remaining branches 226*b*, 226*c*, and a single air flow meter 66*e* is disposed in the inlet 224 of the bypass pipe 222.

The air flow meters 66*a*, 66*d* highly accurately detect the respective amounts of intake air, which are drawn into the first and fourth cylinder chambers 202*a*, 202*d*. The air flow meter 66*e* disposed in the inlet 224, and the rotational angle sensor 234, are used in combination to detect, with high accuracy, the amounts of intake air that are drawn respectively into the second and third cylinder chambers 202*b*, 202*c*. The number of air flow meters 66 that may be disposed in the bypass pipe 222 is not limited, insofar as at least one air flow meter is disposed in the bypass pipe 222.

The cost of the intake system 200*a* shown in FIG. 12 is relatively low, because of the reduced number of air flow meters 66 that are used. However, the amounts of intake air drawn into the engine 204 can still be detected with high accuracy by the intake system 200*a* shown in FIG. 12.

Figure 13:
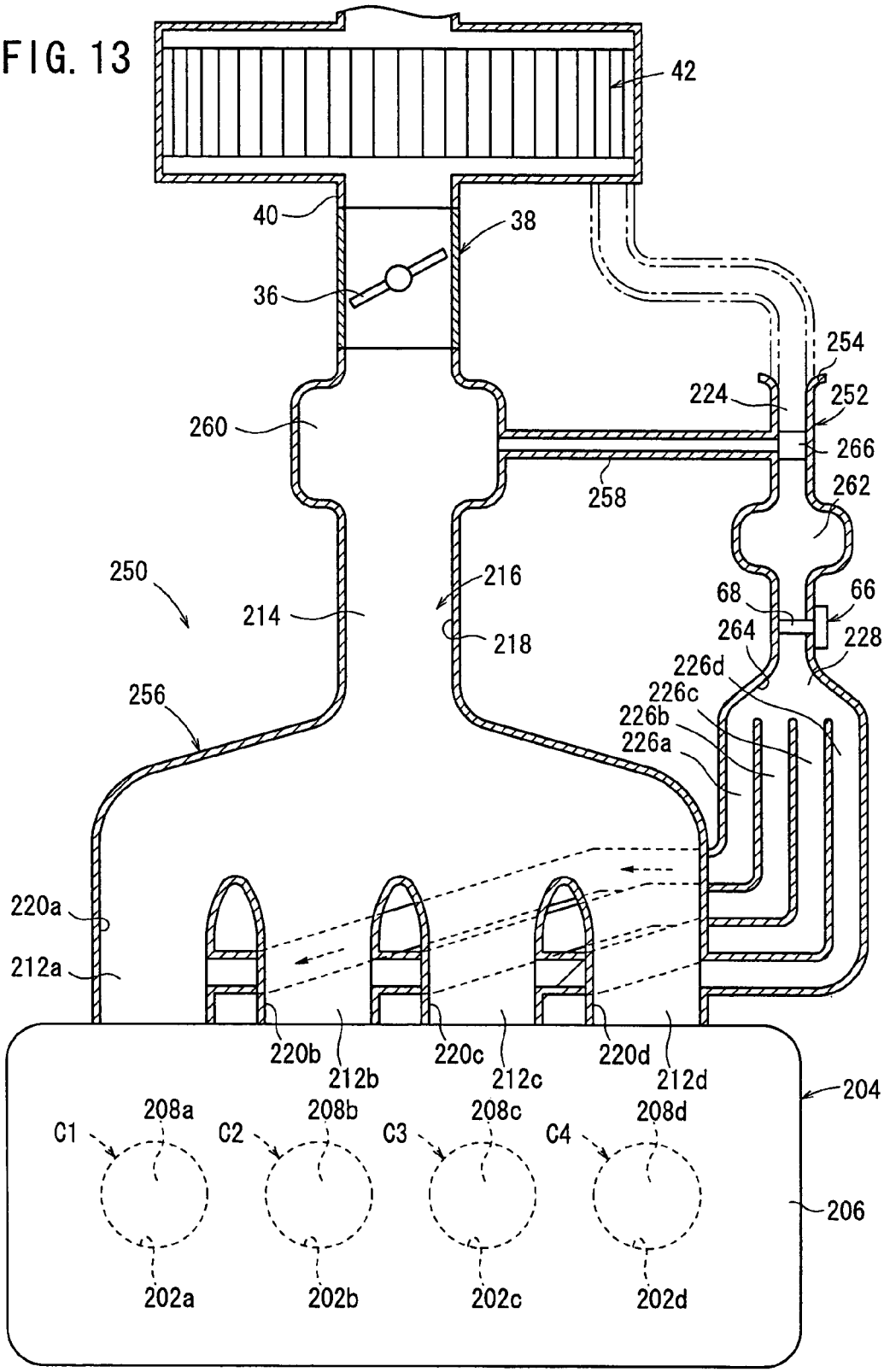
FIG. 13 is a horizontal cross-sectional view of an intake system for an internal combustion engine according to a second modification.

FIG. 13 shows an intake system 250 for an internal combustion engine according to a second modification. Those parts of the intake system 250 which are identical to those of the intake system 200 according to the second embodiment are denoted using identical reference characters, and such features shall not be described in detail below.

The intake system 250 according to the second modification differs from the intake system 200 according to the second embodiment in that a bypass pipe 252 is provided, the bypass pipe 252 having an inlet 224 that includes an open end 254 that opens outwardly, wherein the common pipe 214 of an intake manifold 256 and the inlet 224 of the bypass pipe 252 are connected to each other by a passageway 258.

The intake system 250 also has a first tank 260 having a predetermined volume, which is disposed in the end of the common pipe 214 of the intake manifold 256, and a second tank 262 having a predetermined volume, which is disposed in the inlet 224 of the bypass pipe 252.

The open end 254 of the bypass pipe 252 may be connected to the air cleaner 42 separately from the intake pipe 40 connected to the intake manifold 256, as indicated by the two-dot-and-dash lines in FIG. 13. Stated otherwise, the open end 254 may be connected to a position upstream of the throttle valve 36.

When intake air is introduced from the air cleaner 42 through the intake pipe 40 into the intake manifold 256, intake air is simultaneously introduced through the open end 254 into the bypass pipe 252.

The bypass pipe 252 has a passage 264 defined therein for passing intake air therethrough. The passage 264 is smaller in diameter than the intake passage 216 in the intake manifold 256.

A pressure regulating mechanism 266, e.g., a pressure regulating valve, is disposed in the bypass pipe 252 in facing relation to the passageway 258. The pressure regulating mechanism 266 operates to eliminate any pressure difference between intake air that flows through the intake passage 216 in the intake manifold 256 and intake air that flows through the bypass pipe 252. That is, the pressure regulating mechanism 266 operates to substantially equalize the respective pressures of the intake air flowing through the intake passage 216 and the intake air flowing through the bypass pipe 252.

An air flow meter 66, for detecting the amount of intake air flowing through the bypass pipe 252, is disposed in the inlet 224 of the bypass pipe 252 downstream of the second tank 262.

With the above arrangement, intake air flowing through the bypass pipe 252 is directly introduced from the open end 254 of the bypass pipe 252. Accordingly, intake air flows through the bypass pipe 252 separately from intake air flowing through the intake manifold 256. As a consequence, even when unburned gases, which are produced in the first through fourth cylinder chambers 202*a* through 202*d*, enter the intake manifold 256 downstream of the throttle valve 36, and exhaust gases flow through the intake manifold 256 for exhaust gas recirculation, such unburned gases and exhaust gases are prevented from flowing into the bypass pipe 252.

Therefore, the detecting element 68 of the air flow meter 66 that is disposed in the bypass pipe 252 is prevented from becoming contaminated by unburned gases and exhaust gases, and hence the detection accuracy of the air flow meter 66 for detecting the amount of intake air is more effectively prevented from being lowered.

Figure 14:
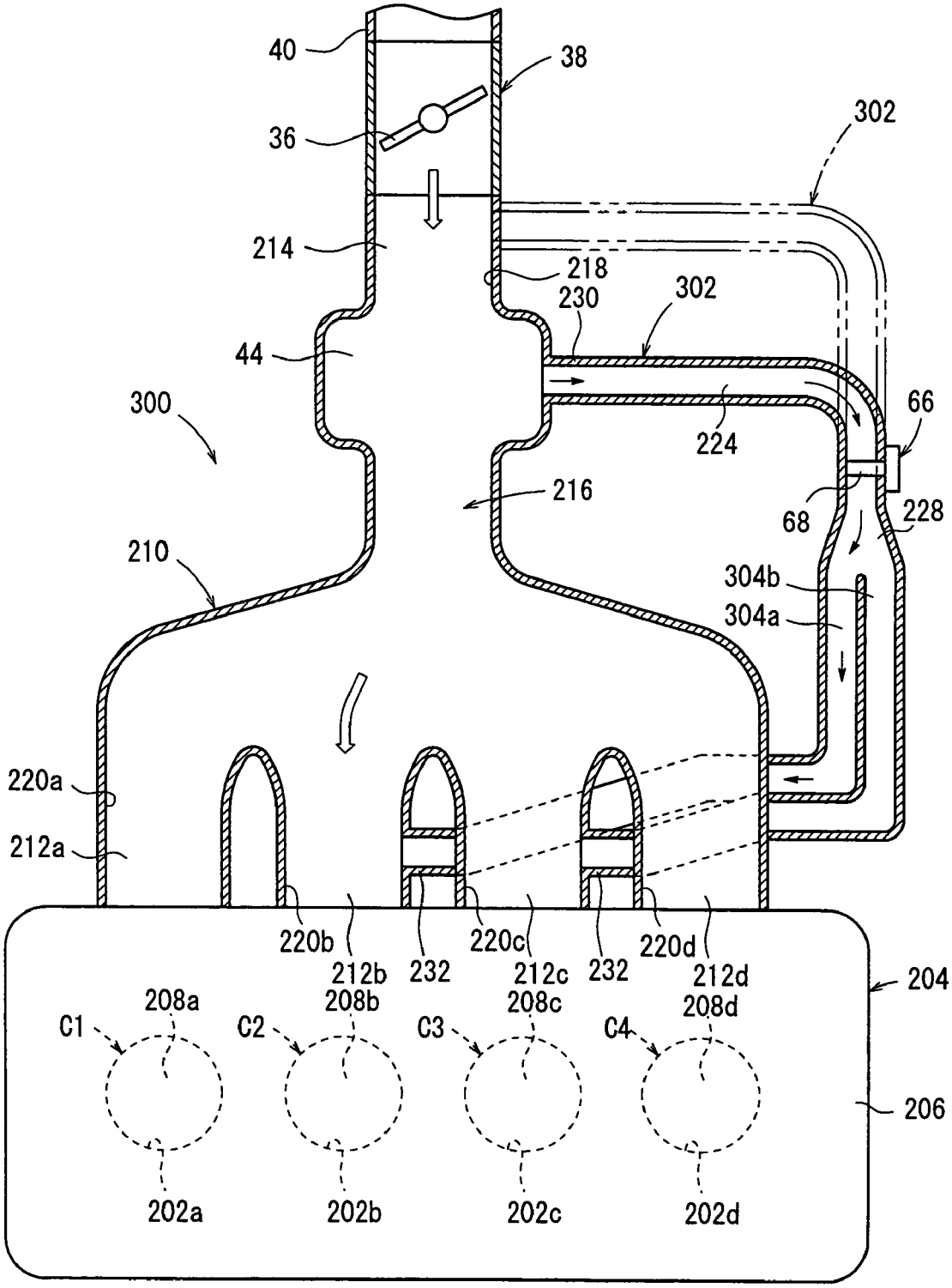
FIG. 14 is a horizontal cross-sectional view of an intake system for an internal combustion engine according to a third embodiment of the present invention.
Figure 15:
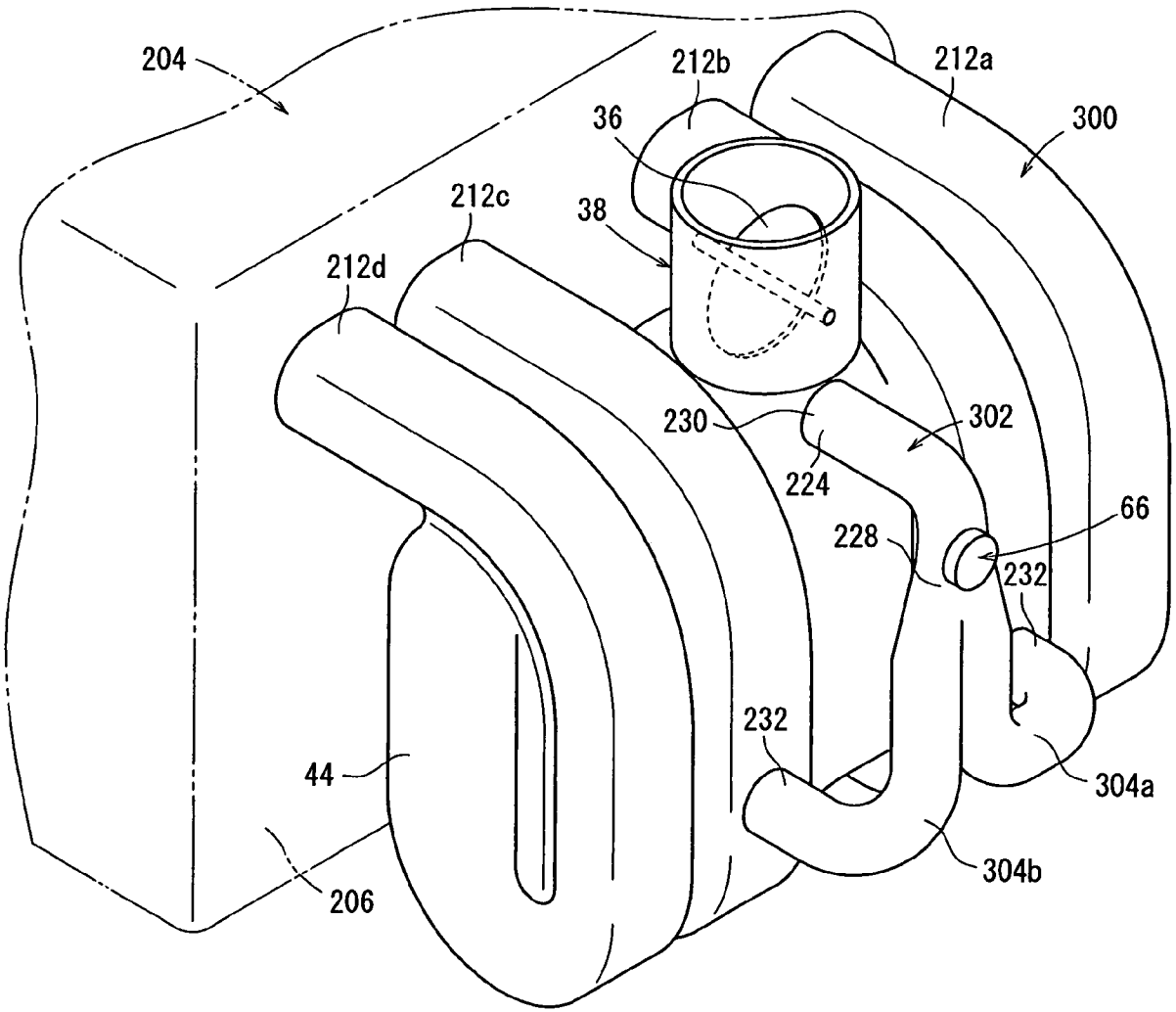
FIG. 15 is a perspective view of an intake manifold incorporating the intake system shown in FIG. 14.

FIGS. 14 and 15 show an intake system 300 for an internal combustion engine according to a third embodiment of the present invention. The method of controlling operation of the internal combustion engine according to the present invention is applied to the intake system 300. Those parts of the intake system 300 which are identical to those of the intake systems 10, 200 according to the first and third embodiments are denoted using identical reference characters, and such features shall not be described in detail below.

The intake system 200 has a bypass pipe (auxiliary intake passage) 302 connected to bypass the manifold section between the tank 44 or the common pipe 214 and the second and third branch pipes 212*b*, 212*c*. Specifically, the bypass pipe 302 is connected only to the centrally located two branch pipes, i.e., the second and third branch pipes 212*b*, 212*c*, of the first through fourth branch pipes 212*a* through 212*d* of the intake manifold 210.

The bypass pipe 302 has an upstream inlet 224 connected to the tank 44 or the common pipe 214, a pair of downstream bifurcated branches 304*a*, 304*b* connected respectively to the second and third branch pipes 212*b*, 212*c*, and a common joint 228 joining the branches 304*a*, 304*b* to the inlet 224.

An air flow meter (amount-of-air detector) 66, for detecting an amount of intake air flowing through the bypass pipe 302, is disposed in the inlet 224. The air flow meter 66 functions as an amount-of-air detector.

Figure 16:
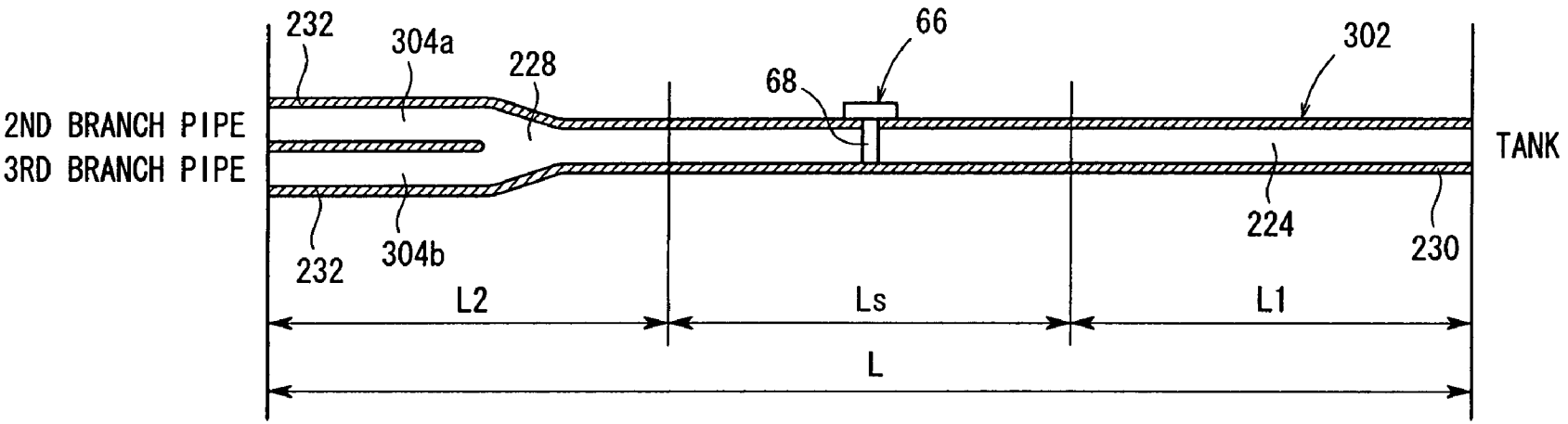
FIG. 16 is a cross-sectional view of a bypass pipe shown in FIG. 14, which is illustrated as a straight bypass pipe.

As shown in FIG. 16, the air flow meter 66 is positioned in a substantially central portion, within the entire axial length L of the bypass pipe 302, between the first connecting end 230 and the second connecting end 232 thereof. Specifically, the air flow meter 66 is positioned between a position spaced from the first connecting end 230 toward the second connecting end 232 by a distance L1 which is at least one-third of the length L, and another position spaced from the second connecting end 232 toward the first connecting end 230 by a distance L2 which is at least one-third of the length L (L1=L2).

Stated otherwise, the air flow meter 66 is positioned within a range Ls that is spaced from the first and second connecting ends 230, 232 by the respective distances L1, L2, both of which are each at least one-third of the length L.

Since the air flow meter 66 is spaced from the first and second connecting ends 230, 232 by the respective distances L1, L2, the air flow meter 66 is placed inside a stable laminar flow of intake air flowing through the bypass pipe 302. Therefore, the air flow meter 66 is capable of reliably detecting an amount of intake air flowing through the bypass pipe 302.

Specifically, negative pressure in the intake manifold 210 varies at all times due to pulsations of the intake air flow, which are produced in the first through fourth branch pipes 212*a* through 212*d* when the first through fourth cylinders C1 through C4 operate in their intake strokes. The pressure in the bypass pipe 302 near the first and second connecting ends 230, 232 tends to increase due to such variations in negative pressure in the intake manifold 210. If the air flow meter 66 were disposed near the first connecting end 230 or the second connecting end 232, then the air flow meter 66 would be more likely to detect an amount of intake air that is drawn unstably, due to such intake air flow pulsations.

According to the third embodiment, the air flow meter 66 is spaced from the first and second connecting ends 230, 232 by the respective distances L1, L2, as described above. Since the flow of intake air flowing into the bypass pipe 302 from the first connecting end 230 thereof, and the flow of intake air flowing into the bypass pipe 302 from the second connecting end 232 thereof, cancel each other in a substantially central portion within the bypass pipe 302, the air flow meter 66 does not detect an amount of intake air flowing through the bypass pipe 302 that is subjected to intake air flow pulsations, but rather, only detects an amount of intake air flowing through the bypass pipe 302 from the first connecting end 230 to the second connecting end 232.

Operations and advantages of the intake system 300, for drawing intake air into the second cylinder C2, shall be described below.

Figure 17:
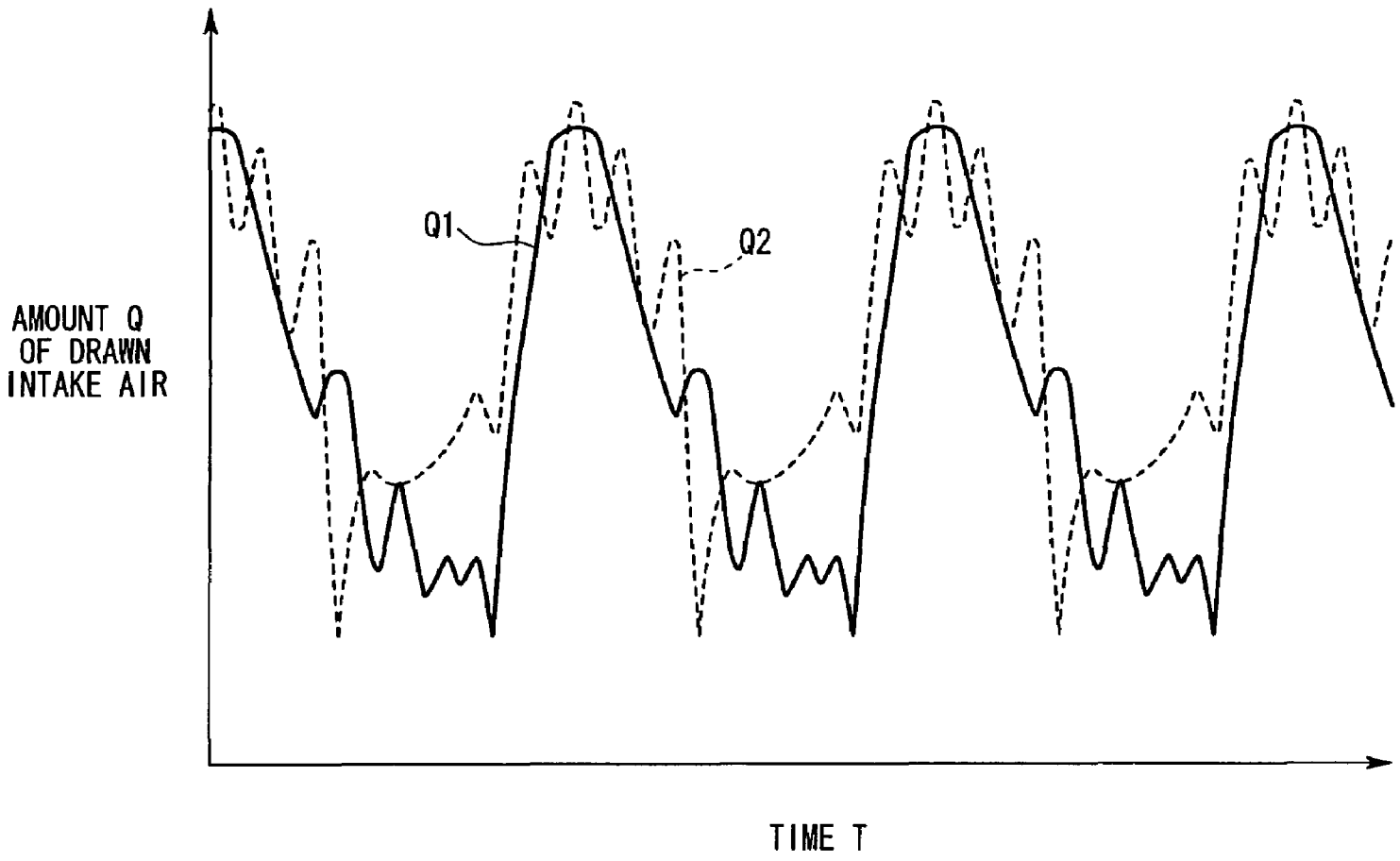
FIG. 17 is a diagram showing characteristic curves representing respective amounts of intake air, plotted against time, that are drawn into the second cylinder of the internal combustion engine.

FIG. 17 shows characteristic curves representing respective amounts Q of intake air, plotted against time, that are drawn into the second cylinder chamber 202*b* and which are detected by the air flow meter 66 per unit time T. In FIG. 17, the amount Q1 of intake air represented by the solid-line curve is detected by the air flow meter 66, which is positioned in a substantially central portion in the bypass pipe 302, and the amount Q2 of intake air represented by the broken-line curve is detected by the air flow meter 66, which is positioned near the first connecting end 230 or the second connecting end 232 of the bypass pipe 302.

As can be seen from FIG. 17, since it is positioned in a substantially central portion within the length L of the bypass pipe 302, the air flow meter 66 detects the amount Q1 of intake air as represented by the solid-line characteristic curve, having a plurality of peaks spaced at intervals depending on the intake timing of the second cylinder C2. Since it is positioned near the first connecting end 230 or the second connecting end 232 of the bypass pipe 302, the air flow meter 66 detects the amount Q1 of intake air as represented by the broken-line characteristic curve, having closely spaced wavy pulsations depending on the intake timing of the second cylinder C2.

The air flow meter 66 positioned in a substantially central portion in the bypass pipe 302 is thus capable of detecting an amount of intake air that flows in a stable laminar flow through the bypass pipe 302, during the intake stroke of the engine 204.

In the third embodiment, branches 304*a*, 304*b* of the bypass pipe 302 are connected to the second and third branch pipes 212*b*, 212*c* of the intake manifold 210. However, the branch pipe 302 may be connected to only one of the first through fourth branch pipes 212*a* through 212*d*, or the branch pipe 302 may have branches connected to two or more of the first through fourth branch pipes 212*a* through 212*d*.

In these modifications, the air flow meter 66 should be positioned in a substantially central portion within the length L of the bypass pipe 302.

According to the third embodiment, as described above, the air flow meter 66 is positioned in a substantially central portion in the bypass pipe 302 so as to be spaced from the first connecting end 230 connected to the tank 44 by at least one-third of the length L of the bypass pipe 302, and also from the second connecting end 232 connected to the second and third branch pipes 212*b*, 212*c* by at least one-third of the length L of the bypass pipe 302. The air flow meter 66, positioned in this manner, is capable of detecting highly accurately the amount of intake air flowing through the bypass pipe 302, without being affected by intake air flow pulsations produced in the intake manifold 210 during the intake stroke.

Therefore, the amount of fuel to be injected is controlled based on amounts of intake air that are drawn into the respective first through fourth cylinder chambers 202*a* through 202*d*, and which are detected by the air flow meter 66. Accordingly, the engine 204 can be controlled highly accurately in real time, based on the amount of drawn intake air and the amount of injected fuel.

Although certain preferred embodiments of the present invention have been shown and described in detail, it should be understood that various changes and modifications may be made therein without departing from the scope of the appended claims.

What is claimed is:

1. An intake system for use in an internal combustion engine, comprising:

an intake manifold having a main intake passage defined therein;

a throttle valve connected to said intake manifold and openable and closable for regulating an amount of intake air drawn through said main intake passage into the internal combustion engine; and an injector for injecting an amount of fuel depending on the regulated amount of intake air drawn into the internal combustion engine, wherein said intake manifold further comprises an auxiliary intake passage disposed separately from said main intake passage and connected to said main intake passage, and an amount-of-air detector disposed in said auxiliary intake passage for detecting an amount of intake air drawn into the internal combustion engine, and wherein said auxiliary intake passage has one of opposite ends thereof connected to said intake manifold downstream of said throttle valve.

2. An intake system according to claim 1, wherein one of the opposite ends of said auxiliary intake passage is connected to an upstream portion of said intake manifold, and the other of the opposite ends of said auxiliary intake passage is connected to a downstream portion of said intake manifold.

3. An intake system according to claim 1, wherein one of the opposite ends of said auxiliary intake passage is connected to said intake manifold, and the other of the opposite ends of said auxiliary intake passage is connected to said intake manifold upstream of said throttle valve.

4. An intake system according to claim 3, further comprising a passageway connected between said main intake passage and said auxiliary intake passage of said intake manifold and holding said main intake passage and said auxiliary intake passage in fluid communication with each other, wherein said auxiliary intake passage has a pressure regulating mechanism for holding the pressure of intake air flowing through said main intake passage and the pressure of intake air flowing through said auxiliary intake passage substantially equal to each other through said passageway.

5. An intake system according to claim 1, wherein said intake manifold has a plurality of branch pipes connected to a main body of said internal combustion engine and a common pipe connected to said branch pipes, and said auxiliary intake passage has a plurality of branches associated respectively with said branch pipes and a common joint joining said branches, said branches being connected to said main intake passage downstream of said throttle valve.

6. An intake system according to claim 5, wherein said amount-of-air detector comprises a plurality of amount-of-air detectors disposed respectively in said branches.

7. An intake system according to claim 6, wherein said amount-of-air detectors are fewer in number than said branch pipes of said intake manifold.

8. An intake system according to claim 5, wherein said common joint of said auxiliary intake passage is connected to said intake manifold upstream of said throttle valve.

9. An intake system according to claim 8, further comprising a passageway connected between said main intake passage and said auxiliary intake passage of said intake manifold and holding said main intake passage and said auxiliary intake passage in fluid communication with each other, wherein said auxiliary intake passage has a pressure regulating mechanism for holding the pressure of intake air flowing through said main intake passage and the pressure of intake air flowing through said auxiliary intake passage substantially equal to each other through said passageway.

10. An intake system according to claim 1, wherein said amount-of-air detector is disposed in a substantially central portion within an axial length of said auxiliary intake passage.

11. An intake system according to claim 1, wherein said amount-of-air detector is disposed in a range which is spaced from both an end of said auxiliary intake passage, which is connected to said common pipe of said main intake passage by at least one-third of the axial length of said auxiliary intake passage, and an opposite end of said auxiliary intake passage, which is connected to branch pipes of said main intake passage by at least one-third of the axial length of said auxiliary intake passage.

12. A method of controlling operation of an internal combustion engine having an intake manifold having a main intake passage defined therein, a throttle valve connected to said intake manifold and openable and closable for regulating an amount of intake air drawn through said main intake passage into the internal combustion engine, an injector for injecting an amount of fuel depending on the regulated amount of intake air into the internal combustion engine, said intake manifold also having an auxiliary intake passage disposed separately from said main intake passage and connected to said main intake passage, and an amount-of-air detector disposed in said auxiliary intake passage for detecting an amount of intake air drawn into the internal combustion engine, said method comprising the steps of:

calculating a change in an actual amount of intake air drawn into the internal combustion engine from the difference between the actual amount of intake air drawn into the internal combustion engine, which is detected in a last intake stroke by said amount-of-air detector, and the actual amount of intake air drawn into the internal combustion engine, which is detected in an intake stroke before last by said amount-of-air detector;

multiplying the calculated change in the actual amount of intake air by a coefficient based on a change in a throttle opening of the internal combustion engine which varies depending on an operating state of the internal combustion engine, thereby correcting the change in the actual amount of intake air into an estimated change of intake air to be drawn into the internal combustion engine;

adding the estimated change of intake air to the actual amount of intake air drawn into the internal combustion engine in the last intake stroke, thereby estimating an amount of intake air to be drawn into the internal combustion engine in a next intake stroke; and calculating an amount of fuel to be injected into the internal combustion engine based on the estimated amount of intake air to be drawn into the internal combustion engine in the next intake stroke, and supplying the calculated amount of fuel into the internal combustion engine.

13. A method according to claim 12, wherein the amount of intake air to be drawn into the internal combustion engine in the next intake stroke is estimated, using the volume of a cylinder chamber of the internal combustion engine into which the intake air is drawn, as an upper limit for the estimated amount of intake air.

14. A method of controlling operation of a multicylinder internal combustion engine having a plurality of cylinder chambers which provide first through fourth cylinders, respectively, an intake manifold having a main intake passage defined therein and a plurality of branch pipes connected respectively to said cylinder chambers, and a throttle valve connected to said intake manifold and openable and closable for introducing intake air through said main intake passage and said branch pipes into said cylinder chambers, said intake manifold also having an auxiliary intake passage disposed separately from said main intake passage and connected to said main intake passage, and an amount-of-air detector disposed in said auxiliary intake passage for detecting an amount of intake air drawn into the internal combustion engine, said method comprising the steps of:

calculating a change in an actual amount of intake air drawn into the internal combustion engine from the difference between the actual amount of intake air drawn into the first cylinder of the internal combustion engine, which is detected in a last intake stroke by said amount-of-air detector, and the actual amount of intake air drawn into the first cylinder of the internal combustion engine, which is detected in an intake stroke before last by said amount-of-air detector;

multiplying the calculated change in the actual amount of intake air by a coefficient based on a change in a throttle opening of the internal combustion engine which varies depending on an operating state of the internal combustion engine, thereby correcting the change in the actual amount of intake air into an estimated change of intake air to be drawn into the internal combustion engine;

adding the estimated change of intake air to the actual amount of intake air drawn into the second cylinder of the internal combustion engine in the last intake stroke, thereby estimating an amount of intake air to be drawn into the second cylinder of the internal combustion engine in a next intake stroke; and calculating an amount of fuel to be injected into the internal combustion engine based on the estimated amount of intake air to be drawn into the internal combustion engine in the next intake stroke, and supplying the calculated amount of fuel into the internal combustion engine.

15. A method according to claim 14, wherein if the detection of the amount of intake air drawn into said first cylinder in an intake stroke thereof, which is immediately prior to the intake stroke of the second cylinder, is not completed, the amount of intake air to be drawn into the second cylinder of the internal combustion engine in the next intake stroke is estimated based on a change in the actual amount of intake air drawn into the internal combustion engine from the difference between the actual amount of intake air drawn into the third cylinder in an intake stroke thereof which is immediately prior to the intake stroke of the first cylinder and the actual amount of intake air drawn into the third cylinder in an intake stroke before last thereof.

16. A method according to claim 15, wherein the detection of the amount of intake air by said amount-of-air detector is completed when a maximum value of the actual amount of intake air drawn into the internal combustion engine is detected by said amount-of-air detector, and the actual amount of intake air drawn into the internal combustion engine is estimated in its entirety from the actual amount of intake air detected up to the maximum value thereof.

17. A method according to claim 14, wherein the amount of intake air to be drawn into the internal combustion engine in the next intake stroke is estimated, using the volume of each of the cylinder chambers of the internal combustion engine into which the intake air is drawn, as an upper limit for the estimated amount of intake air.

* * * * *